US006001003A

United States Patent [19]

Park

[11] Patent Number: 6,001,003

[45] Date of Patent: Dec. 14, 1999

[54] WAVE BEVELING MACHINE

[76] Inventor: Kyung Park, 71-13 Doo-Jeong Dong, Cheon-An-Shi, Choong-Cheong-Nam Do, Rep. of Korea, 330-210

[21] Appl. No.: 09/076,052

[22] Filed: May 11, 1998

[51] Int. Cl.[6] ..... B24B 51/00

[52] U.S. Cl. ..... 451/157; 451/260

[58] Field of Search ..... 451/44, 65, 167, 451/260, 267, 282, 157

[56] References Cited

U.S. PATENT DOCUMENTS

| | | | |
|---|---|---|---|
| 2,754,956 | 7/1956 | Sommer | 451/260 X |
| 4,079,551 | 3/1978 | Brando | 451/260 |
| 4,375,141 | 3/1983 | Gaetano | 451/65 |
| 4,426,811 | 1/1984 | Eckardt et al. | 451/44 X |
| 5,265,382 | 11/1993 | Park . | |
| 5,327,686 | 7/1994 | Park . | |
| 5,433,652 | 7/1995 | Park . | |
| 5,613,894 | 3/1997 | Delle Vedove . | |

*Primary Examiner*—Robert A. Rose
*Assistant Examiner*—Anthony Ojini
*Attorney, Agent, or Firm*—Kolisch, Hartwell, Dickinson, McCormack & Heuser

[57] ABSTRACT

A wave beveling machine is disclosed which produces a wave bevel on a glass work piece. The machine includes a feed path that is adapted to receive a glass work piece and which includes a plurality of spaced-apart treatment heads adjacent the feed path and adapted to sequentially engage the edge region of the work piece as the work piece is moved along the feed path. Each of the plurality of heads includes at least one contact region adapted to contact the edge region of the work piece, and one or more of the heads is adapted to abrade glass from the edge region when in contact with the edge region. The machine further includes a treatment head positioning system adapted to cause the contact surfaces of the plurality of heads and the edge region of the work piece to be engaged and cyclically moved in an oscillating path with respect to each other to produce the wave bevel on the edge region. The machine may further include one or more conveyors that support and move the work piece along the feed path. Furthermore the heads may be mounted on a single carriage, on which they move or are engaged as a unit, or may be independently mounted, wherein they may each be controlled and positioned by the treatment head positioning system independent of the rest of the plurality of heads.

20 Claims, 12 Drawing Sheets

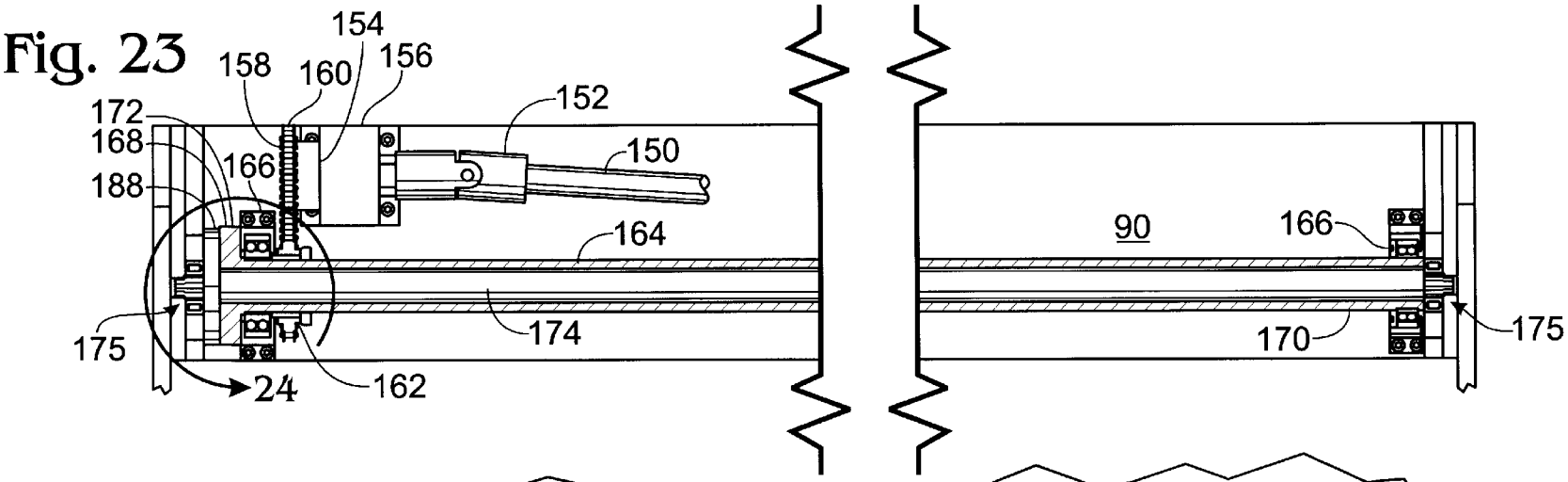
Fig. 23
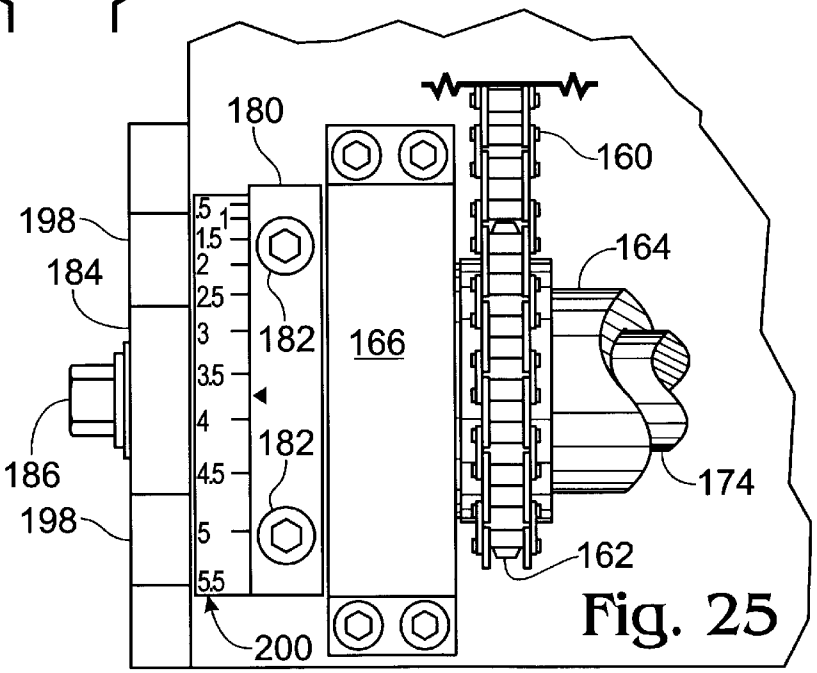
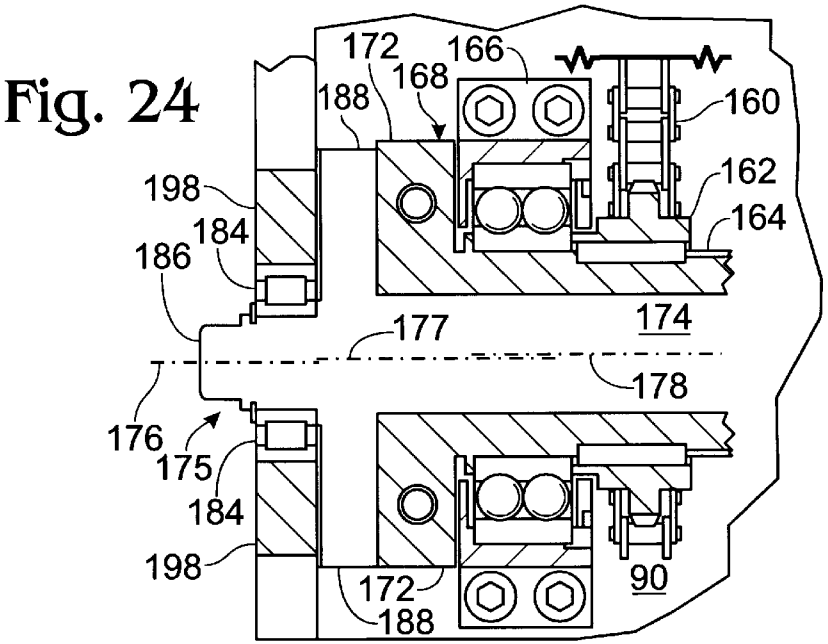
Fig. 24
Fig. 25

40
12
16
18
14
82
82'
86
86'
88
88'
104
104'
202

WAVE BEVELING MACHINE

BACKGROUND OF THE INVENTION

Panes of glass are often beveled to improve their appearance. Beveling a pane of glass involves removing a portion of the glass to give the pane a more ornate and aesthetically pleasing appearance. Bevels generally include a height, a width and a bevel angle or pitch. For example, and as used herein, in a plane of glass having a pair of opposed faces and an edge extending between the faces, the height of the bevel is measured along the edge transverse to the faces, the bevel width is measured along the plane of the faces transversely from the edge, and the bevel angle is measured between the plane of one of the faces and the produced bevel.

Conventional glass beveling machines come in two general forms. The first is a single-headed machine, which is commonly called a shape beveling machine. The machine supports a pane of glass and rotates it with respect to a grinding head. The head rotates at a fixed bevel angle with respect to the edge region of the pane to bevel the edge region as the pane is rotated with respect to the head. The bevel angle of the head is adjustable prior to use to control the height and width of the resulting bevel, but remains at a determined angle when the machine is being used. As a result, the produced bevel has a constant height and width along the edge region of the pane. The machine may include positioning rollers that follow or trace the edge of the glass to orient the head with respect to the edge region. Other embodiments of this type of machine use a template that is followed or traced to define the path of the head. These machines are useful because they can bevel the entire perimeter of a pane of glass as the pane is rotated with respect to the head. However, the machines are rather slow and labor intensive because the single head requires multiple passes with a variety of heads to completely bevel and polish the edge region of the glass. In addition, these machines only work with panes of glass that do not have sharp corners so that the tracer can follow the perimeter of the glass. Examples of these machines are illustrated in U.S. Pat. Nos. 4,989,323, 5,028,182, 5,074,079, 5,265,382 and 5,433,652 to Park, the disclosures of which are hereby incorporated by reference.

The other general type of conventional beveling machine is a multi-headed machine that is commonly referred to as a straight beveling machine. The machine is much faster than the above-described tracing machine, however it is only suited for use on glass plates or panes that have straight edges. The machine includes a plurality of spaced-apart heads (typically at least nine) and a track or feed path along which the glass plate is fed through the machine and into contact with the heads. The heads collectively bevel and polish one edge of the plate at a time, and the heads typically are arranged to begin with rather coarse grinding heads and end with polishing heads. The machine may also include an edging head that "seams" the edge of the work piece so the edge is not sharp. In some embodiments, the heads are adjustable, in that they may be positioned prior to use to adjust the bevel width, bevel angle and to accommodate the fact that glass plates come in a variety of thicknesses. After being initially positioned, however, the heads remain fixed in their defined positions while the glass pane is fed through the machine.

One specific type of bevel is a wave bevel, in which either or both of the height and the width oscillate along the length of the edge region of the pane of glass. Typically, the oscillating width and/or height periodically vary along the length of the edge region, however, in some embodiments the wavelength and degree of variance are not constant. Wave bevels further improve the appearance of a pane of glass over conventional bevels, but they are much more difficult to produce, especially on a pane of glass with straight edges.

Before the invention disclosed herein, it was only possible to produce a wave bevel using the temple-following form of a single-headed beveling machine. This type of machine can be adapted to produce wave bevels when an appropriate template is used to cause the head to move in and out with respect to the edge. Because of the single head, however, it is necessary to make repeated passes along the edge region of the work piece with a variety of treatment heads to produce the finished wave bevel. Generally, the initial pass is made with a fairly coarse grinding head, then that head is replaced with a somewhat smoother head and the grinding process is repeated. This process is repeated a number of times with less abrasive grinding heads, including very smooth polishing heads.

Because of the number of times the work piece must be engaged by the heads, as well as the time needed to remove and replace each of the treatment heads, the above-described process is extremely slow and labor intensive. This causes the wave beveled glass to be much more expensive than a conventionally beveled pane of glass. By way of example, a pane of glass with a simple bevel may be three times as expensive as a similar pane without beveling, and a pane of glass with a wave bevel may be three times as expensive as a similar pane with a simple bevel. Furthermore, because existing wave beveling machines must follow a template to position the treatment head with respect to the edge region, they cannot easily produce a wave bevel on the corner regions of the pane of glass. More specifically, the head cannot properly maneuver around a corner without losing contact with the edge or the template. Therefore, each of the generally straight edges forming the corner must be separately beveled, thereby further increasing the time and labor necessary to produce a wave bevel along the entire perimeter of the pane of glass.

SUMMARY OF THE INVENTION

The invention achieves these and other objects and advantages in the form of a wave beveling machine that has a feed path adapted to receive a glass work piece and which includes a plurality of spaced-apart treatment heads adjacent the feed path and adapted to sequentially engage the edge region of the work piece as the work piece is moved along the feed path. Each of the plurality of heads includes at least one contact region adapted to contact the edge region of the work piece, and one or more of the heads is adapted to abrade glass from the edge region when in contact with the edge region. The machine further includes a controller adapted to cause the contact surfaces of the plurality of heads and the edge region of the work piece to be engaged and cyclically moved in an oscillating path with respect to each other to produce the wave bevel on the edge region. The machine may further include one or more conveyors that support and move the work piece along the feed path. Furthermore the heads may be mounted on a single carriage, on which they move or are engaged as a unit, or may be independently mounted, wherein they may each be controlled and positioned by the controller independent of the rest of the plurality of heads.

These and other advantages and features of the invention will become more fully apparent as the detailed description below is read with reference to the accompanying drawings.

BRIEF DESCRIPTION OF THE DRAWINGS

FIG. 23 is a bottom plan view of the bed and a portion of the translation control system shown in FIG. 16 with the bottom half of the main shaft and the bearing cases broken away to show details of internal construction.

FIG. 24 is an enlarged detail taken along the curved line 24 in FIG. 23.

FIG. 25 is a plan view of the detail shown in FIG. 24.

DETAILED DESCRIPTION OF THE PREFERRED EMBODIMENTS AND BEST MODE OF THE INVENTION

Figure 1:
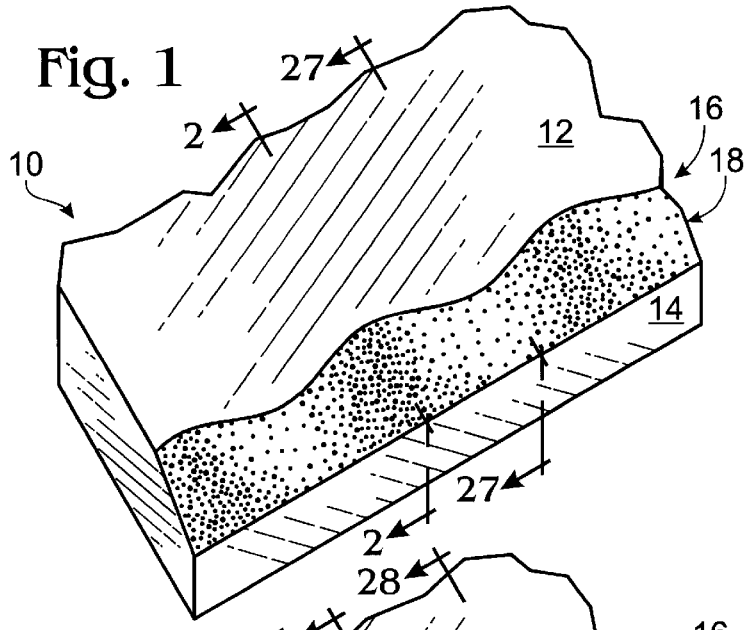
FIG. 1 is an isometric view of a wave bevel with an oscillating width.

As discussed above, wave bevels are considerably more difficult to make than standard bevels because of the more complex interactions required between the grinding head or heads and the edge region of the piece of glass. As used herein, the term "wave bevel" is meant to refer to a bevel in which either the height or width of the bevel, or both, oscillate along the length of the bevel, unlike a standard bevel in which the height and width are constant along the length of the bevel.

Examples of wave bevels are shown in FIGS. 1–6. In each of the figures, a glass work piece is indicated generally at 10 and includes a pair of opposed faces 12 and an edge 14 extending between the faces. Work piece 10 further includes an edge region 16 defined by edge 14 and a portion of at least one of faces 12. Each edge region 16 includes a wave bevel that is generally indicated at 18 and has a width 20 and a height 22, which are measured in the general directions indicated in the figures. As mentioned previously and as used herein, the width of the wave bevel is measured along the plane of face 12 transverse to edge 14, although it is understood that in the glass industry the width of a bevel is generally measured from the edge and along the bevel between the edge and the face.

Figure 2:
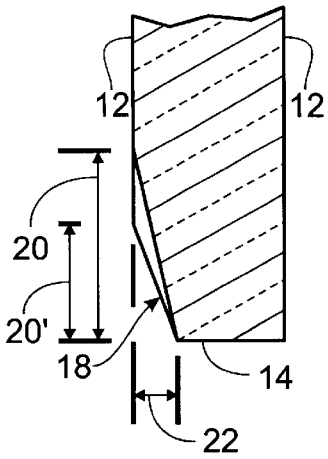
FIG. 2 is a cross-sectional view of the wave bevel of FIG. 1 taken along the line 2—2 in FIG. 1.
Figure 3:
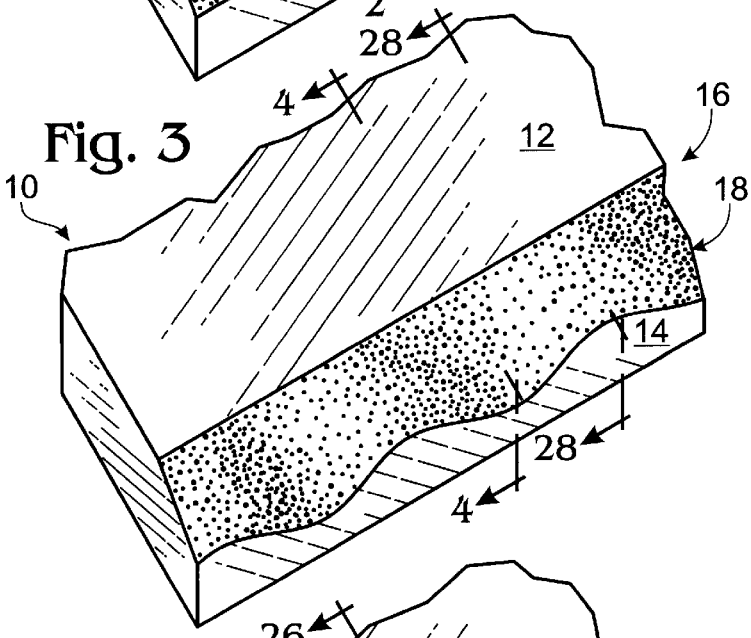
FIG. 3 is an isometric view of a wave bevel with an oscillating height.
Figure 4:
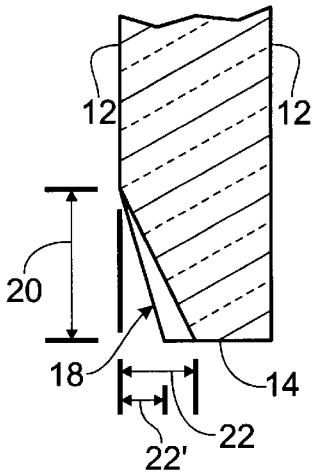
FIG. 4 is a cross-sectional view of the wave bevel of FIG. 3 taken along the line 4—4 in FIG. 4.
Figure 5:
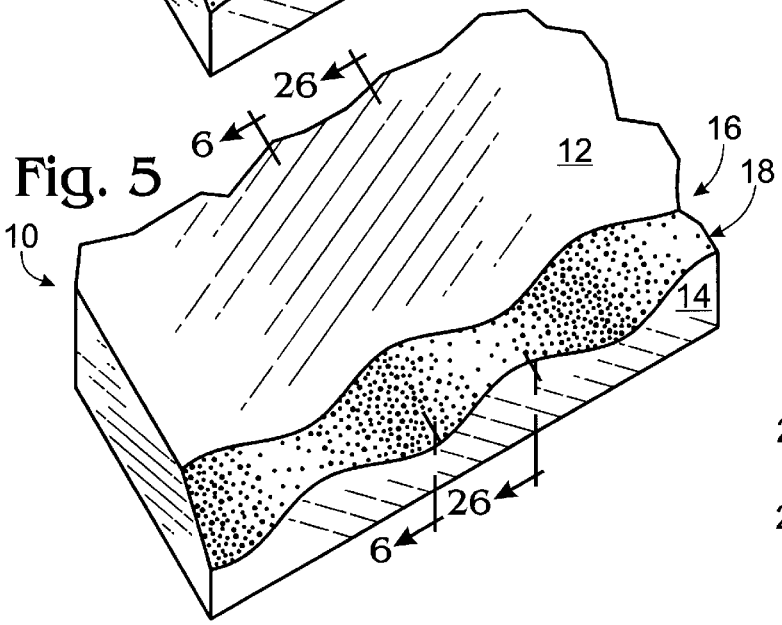
FIG. 5 is an isometric view of a wave bevel with an oscillating height and an oscillating width.
Figure 6:
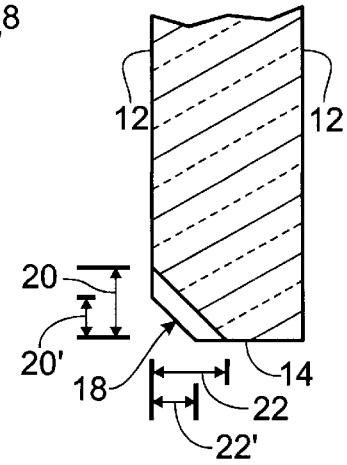
FIG. 6 is a cross-sectional view of the wave bevel of FIG. 5 taken along the line 6—6 in FIG. 5.

In FIGS. 1 and 2, the wave bevel has a constant height 22 and a width that oscillates between widths 20 and 20'. In FIGS. 3 and 4, the wave bevel has a constant width 20 and a height that oscillates between heights 22 and 22'. In FIGS. 5 and 6, the width and the height of the wave bevel oscillate respectively between widths 20 and 20' and heights 22 and 22'. Furthermore, each bevel 18 has a bevel angle or angles, which are measured from the plane of the beveled face 12 to the surface of bevel 18.

In each of the examples of wave bevels shown in FIGS. 1–6, the oscillating widths and/or heights are periodically oscillated so that the spacing between corresponding points on each wave are equally spaced from each other along the length of the wave. It should be understood that wave bevels which oscillate, but do not periodically oscillate, can also be produced with the invented wave beveling machine, as discussed below. Also, the relative heights, widths and bevel angles shown are simply illustrative examples of three types of wave bevels, and wave bevels with greater or less variance in height, width and bevel angle are within the scope of the present invention and may be produced by the wave beveling machine described herein.

Now that it is understood by illustration and description what is meant by the term wave bevel, as opposed to a conventional bevel, the invented machine and method for producing these wave bevels will be described. Also, for the purposes of illustration, examples of suitable sizing and spacing of the components of the machine are described below. It should be understood that these are merely provided as an illustrative example and that the dimensions of these components may be varied within any suitable limits to adapt the machine to produce a variety of shapes and types of wave bevels on different types of glass or other work pieces. In FIGS. 7–10, a wave beveling machine constructed according to a first preferred embodiment of the invention is shown and indicated generally at 30. Machine 30 includes a frame 32 with a work zone 34 and a feed path 36 that extends through the work zone. Feed path 36 includes an entrance 38 through which a glass work piece 40 is fed into work zone 34, and an exit 42 through which work piece 40 is removed from work zone 34.

Machine 30 includes a transport mechanism that moves work piece 40 through the work zone. As shown in FIGS. 7–10, the transport mechanism includes a system of conveyors that are adapted to move and support work piece 40 along feed path 36 through work zone 34.

Figure 7:
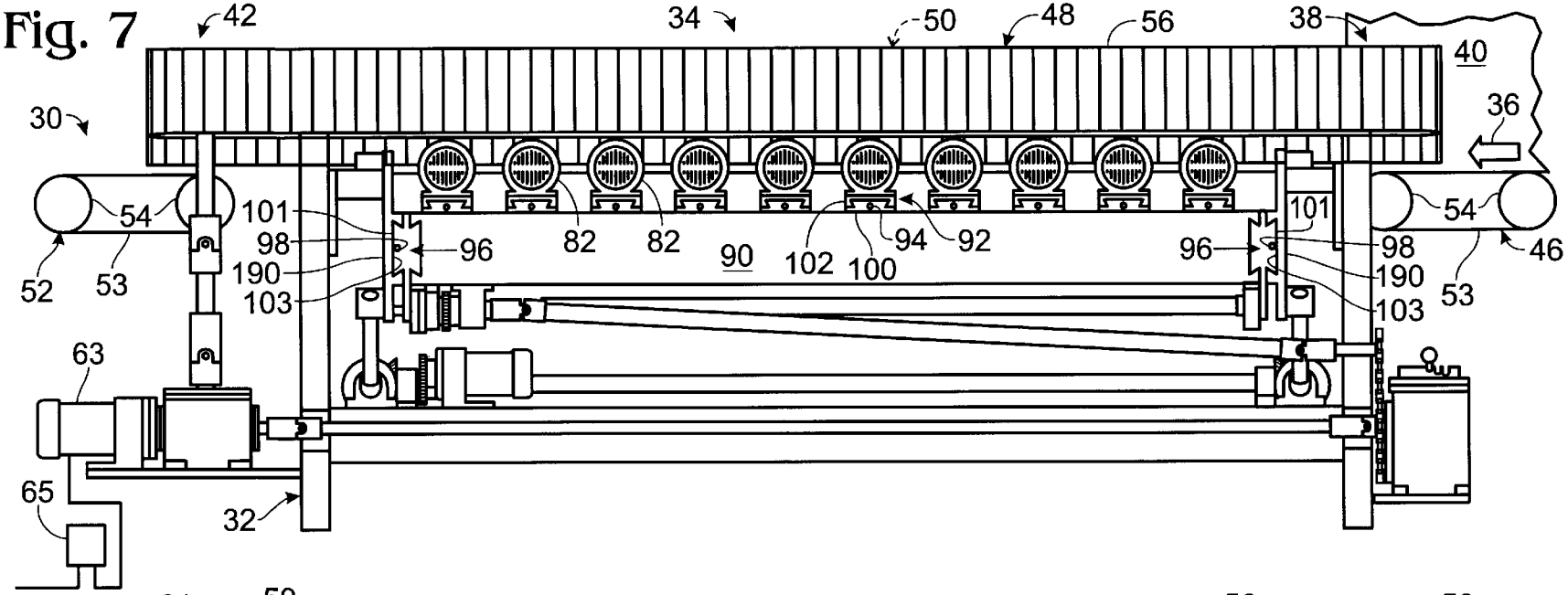
FIG. 7 is a front elevation view of a wave beveling machine constructed according to a preferred embodiment of the present invention.
Figure 8:
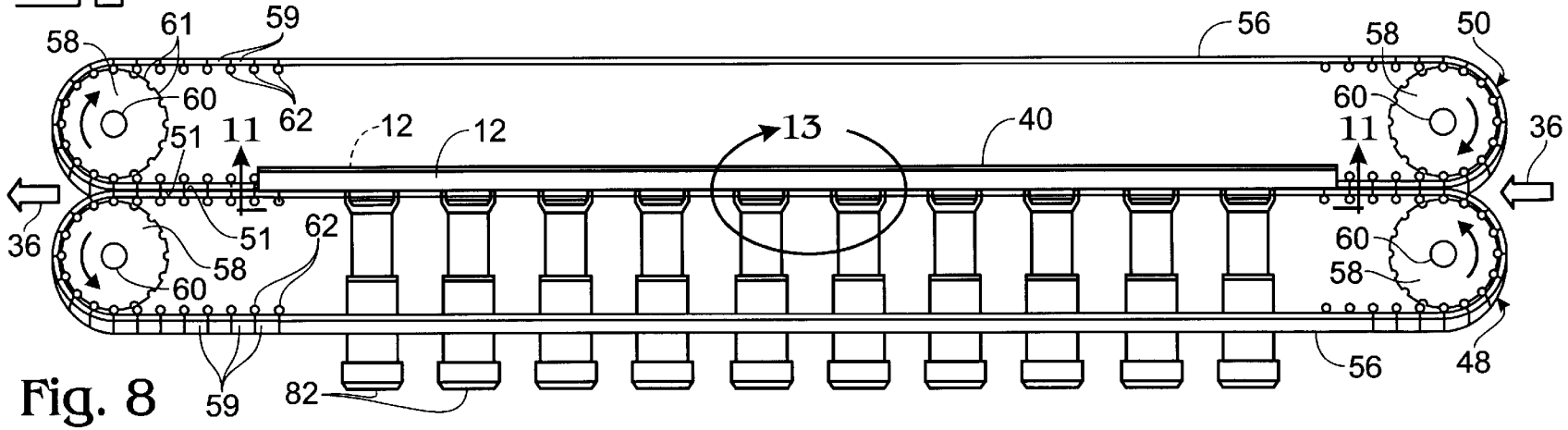
FIG. 8 is a top plan view of the main conveyors and the plurality of treatment heads of the machine of FIG. 7 and showing a glass work piece being moved along the feed path of the machine and sequentially engaged by the plurality of treatment heads.

As shown in FIG. 7, work piece 40 is supported on feed conveyor 46 adjacent entrance 38 of feed path 36. More specifically, edge 14 of work piece 40 is engaged and supported by feed conveyor 46. Feed conveyor 46 is in communication with main conveyors 48 and 50, which are generally opposed to each other and collectively define the portion of feed path 36 within work zone 34. The opposed surfaces 51 of main conveyors 48 and 50 are respectively adapted to engage and support faces 12 of work piece 40 as the work piece is conveyed along the feed path, as shown in FIG. 8. The distance between conveyors 48 and 50 may be adjusted to accommodate work pieces of different thicknesses. It should be understood that the spacing between surfaces 51 should be approximately equal to the thickness of the work piece so that each surface 51 engages one of the faces of the work piece to secure the work piece therebetween. As shown in FIG. 7, adjacent the exit of work zone 34, main conveyors 48 and 50 are in communication with a exit conveyor 52 that is adapted to receive and support the work piece as it exits the work zone along feed path 36.

Each of the feed and exit conveyors 46 and 52 includes a continuous belt 53 that is looped around a pair of sprockets 54, one adjacent each end of the looped belt. As sprockets 54 are rotated about their axles (not shown), belt 53 is drawn along its cyclical path, and any work piece 40 supported thereupon is drawn in the direction of the belt's movement.

As shown in FIG. 8, main conveyors 48 and 50 each include a belt 56 that is formed from a plurality of interconnected segments 59 that enable belt 56 to curvingly conform to the shape of sprockets 58 and the continuous path along which the belt extends. Furthermore, each sprocket 58 includes a plurality of radially spaced teeth 61 adapted to engage spaced-apart ribs 62 extending on the underside of each belt 56. As at least one of sprockets 58 is rotated on its axle 60, its teeth 61 engage ribs 62 and draw the corresponding belt 58 along its continuous path. If the other sprocket 58 is not powered, this movement of the belt along its path causes the other sprocket to rotate about its axle. It should be understood that segments 59 and ribs 62 are spaced-apart along the entire length of belts 56, but have been only shown in FIG. 8 adjacent the sprockets 58 for purposes of illustration. As an illustrative example, if the distance between adjacent ribs 62 on main conveyors 48 and 50 is sixty millimeters, and the corresponding sprockets 58 have sixteen teeth 61, work piece 40 moves 960 millimeters along feed path 36 while sprockets 58 make one full revolution on their axles 60.

Figure 9:
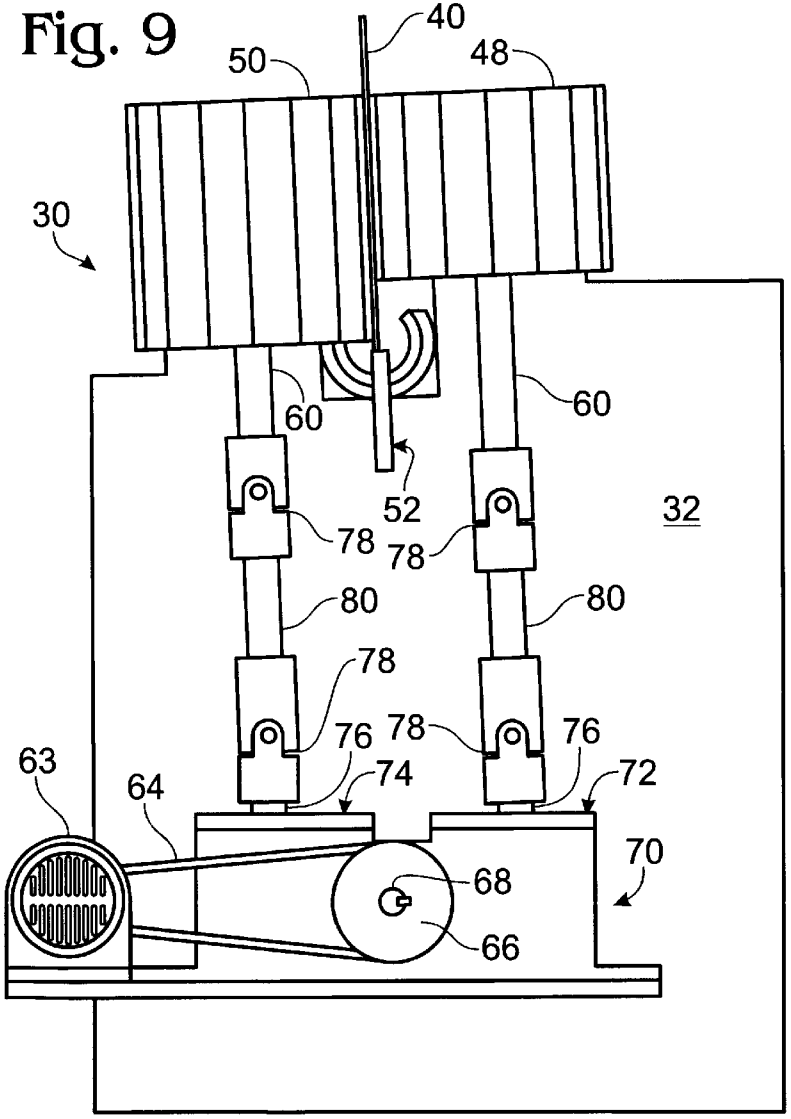
FIG. 9 is a left elevation view of the machine of FIG. 7.

As shown in FIG. 9, main conveyors 48 and 50 are actuated by a motor 63, which provides power to and determines the speed of the conveyors. Motor 63 is coupled via a belt 64 and a pulley 66 to the input shaft 68 of a worm gear reducer 70 that adjusts the speed ratio between the input shaft 68 and the output shafts from the reducer. Typically this speed ratio will result in the output shafts rotating at a slower rate than input shaft 68. For example, ratios of 2:1 to 100:1 or more or less may be used depending on the wavelength, or pitch, of the wave bevel to be produced, the size, stability and precision of the machine, etc. For purposes of illustration, a 20:1 ratio causes sprockets 56 on main conveyors 48 and 50 to complete one full revolution and thus move the work piece 960 millimeters along feed path 36 for every twenty revolutions of input shaft 68.

Reducer 70 includes a forward worm gear reducer 72 and reverse worm gear reducer 74, which each have an output shaft 76 that is respectively connected via a series of universal joints 78 joined by shafts 80, to axles 60 of main conveyors 48 and 50. Universal joints 78 enable the spacing of main conveyors 48 and 50 to be adjusted with respect to each other while maintaining the connection between reducers 72 and 74 and main conveyors 48 and 50. Furthermore, joints 78 and shafts 80 enable this connection to be maintained when the distance between the main conveyors is adjusted to accommodate work pieces of different thicknesses, and in embodiments where the angular orientation of the main conveyors is adjustable with respect to the frame to control the angle of the produced bevel. It should be understood that forward and reverse reducers 72 and 74 rotate in opposite directions to cause main conveyors 48 and 50 to collectively engage the faces 12 of work piece 40 and propel the work piece along feed path 36.

Feed and exit conveyors 46 and 52 may be motor powered, such as described above with respect to either of the main conveyors, or alternatively they be manually powered. For example, a user may place a glass work piece on belt 53 of feed conveyor 46. As the work piece is urged toward work zone 34, the friction between the edge of work piece 40 and belt 53 of the feed conveyor will cause the belt and sprockets to rotate and smoothly guide the work piece into engagement with main conveyors 48 and 50. Similarly, as the beveled work piece is removed from work zone 34 by conveyors 48 and 50, it may engage and be supported by the belt of exit conveyor 52, which in turn causes its belt 53 and sprockets 54 to rotate and collectively support and guide the work piece out of the work zone.

Machine 30 further includes a treatment head positioning system or controller that controls the movement and position of the work piece along the feed path, as well as the speed and path of engagement of the subsequently described treatment heads with the edge region, as described below. The controller includes an inverter 65 which controls and regulates the speed of motor 63, including the power supplied thereto. Controller may be a manually operated, but preferably includes at least some computerized controls that are responsive to user inputs and/or predetermined default or other settings. It should be understood that controller may include a conventional processor and series of sensors, drives, feedback mechanisms, etc.

Figure 10:
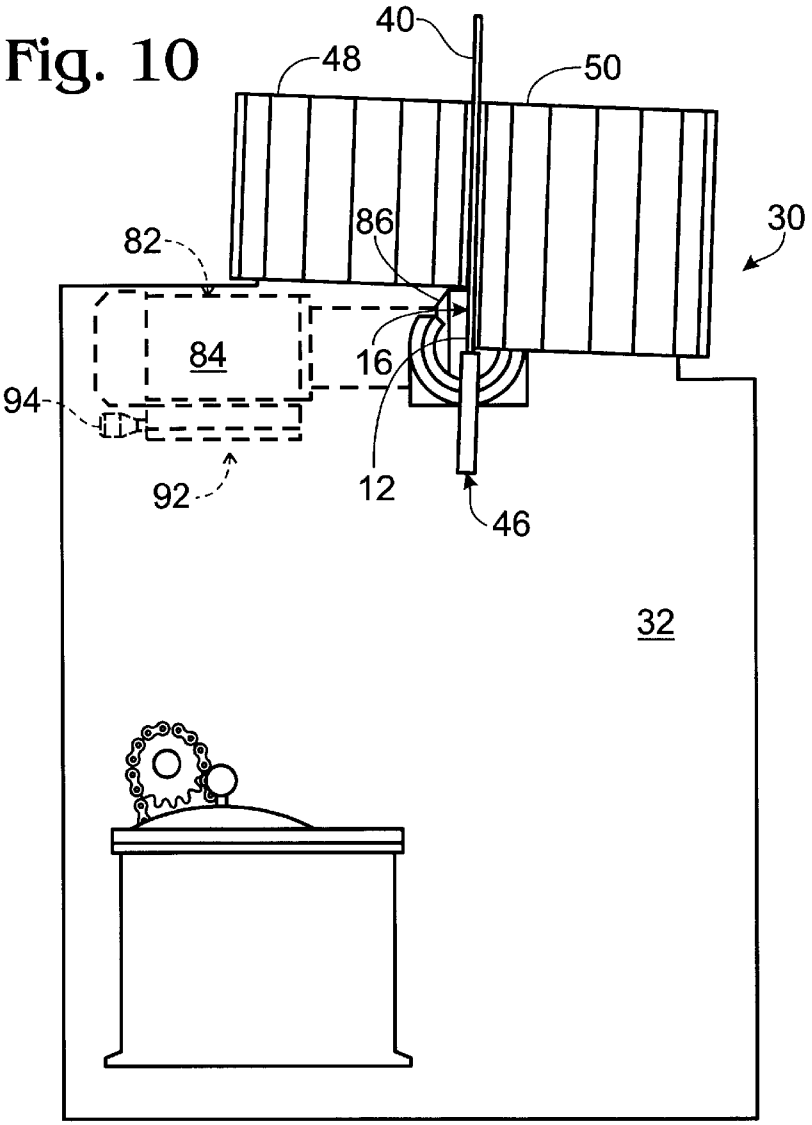
FIG. 10 is a right elevation view of the machine of FIG. 7 with one of the treatment heads shown in dashed lines.

As shown in FIGS. 7–8 and 10, a plurality of treatment heads 82 are positioned in a spaced-apart configuration adjacent feed path 36 within work zone 34. In the glass industry, heads 82 are commonly referred to as grinding wheels, even though they may abrade and/or polish the edge region of the work piece. Perhaps best seen in FIG. 10, each head 82 includes a beveling wheel 86 and a wheel motor 84 that causes wheel motor 86 to rotate about its axis. Each head 82 preferably should have the same size of bevel wheel 86, especially when each wheel has a pair of contact surfaces with the edge region of the work piece. As perhaps best seen in FIG. 13, wheel 86 has a disc-like configuration distal motor 84 with an overall cup-like configuration. Each wheel 86 includes a treatment surface 88 oriented toward edge region 16 of work piece 40. Preferably, the portions of treatment surfaces 88 that are oriented toward edge region 16 have a curved or rounded surface. Treatment surfaces 88 of wheels 84 generally range from a relatively coarse material on the heads near entrance 38 to less or non-abrasive polishing material on the heads near exit 42 of the work zone. It should be understood, however, that the number of heads and the treatment surface of each head may vary according to such factors as the particular glass work piece to be beveled, the desired production rate, the size of the wave bevel and the complexity of the wave bevel to be produced.

As shown in FIGS. 7 and 8, ten heads 82 are spaced equidistantly apart along work zone 34. At least one, and preferably several, of the heads should have treatment surfaces 88 that are adapted to abrade or remove glass from the work piece when in engagement with the edge region of the work piece. Preferably, the heads near the entrance of the work zone are grinding heads that are much coarser than the heads in the center of the work zone, and the heads near the exit of the work zone are much smoother polishing heads rather than coarse grinding heads. Therefore, the initial heads engage the edge region to remove glass to produce, in at least rough form, the desired wave bevel. Then, less coarse grinding heads finish shaping the wave bevel and polishing heads smooth and finish the wave bevel. Therefore, as the plurality of treatment heads sequentially engage the edge region of the work piece, as discussed in more detail below, the treatment surface of each successive head gets finer and finer, ending with heads proximate exit 42 of the work zone that are polishing heads that finish the produced wave bevel 18.

Each head 82 is mounted on a bed 90, and preferably is adjustably mounted on bed 90 to enable the spacing between adjacent heads to be adjusted to enable a wider range of wave bevels to be produced. In addition, the distance between the wheel 86 of each head and feed path 36 is adjustable to compensate for glass work pieces of different thicknesses. As shown in FIG. 7, each head is mounted on a slide 92 which includes an adjustment mechanism 94 (also shown in FIG. 10) that enables the position of each head 82 along its corresponding slide 92 to be selectively locked and released. Preferably, each adjustment mechanism 94 is motorized and driven by the controller or treatment head positioning system, although in some embodiments it may be manually adjusted and secured. As shown, each slide 92 includes male and female members 100 and 102, respectively, that are slidable with respect to each other. Members 100 and 102 define tracks along which the attached heads may be moved and selectively retained by adjustment mechanism 94. In some embodiments of the invention, the angular position of each head with respect to feed path 36 may also be adjusted by an adjustment mechanism that enables the corresponding head 82 to be secured in an angled orientation.

Also shown in FIG. 7 are a pair of outer slides 96, one adjacent each end of bed 90. The outer slides enable the relative position of the entire bed to be adjusted with respect to feed path 36. Outer slides 96 each include male and female members 101 and 103, respectively, which define a track along which bed 90 may be slid and selectively retained by an adjustment mechanism 98. As shown, female members 103 of outer slides 96 extend within a support plate 190, which is pivotally coupled to frame 32 and supports bed 90.

An additional advantage of having bed 90 and each individual head 82 mounted on slides 96 and 92, respectively, is that the position of the plurality of heads can be adjusted as a unit with respect to feed path 36 by adjusting the position of bed 90 using outer slide 96. This way, each individual head 82 does not need to be adjusted. On the other hand, if only a few heads need to be adjusted, such as to adjust the position of a head as its treatment surface is worn away or to pull one or more heads out of service, then slides 92 may be used.

Figure 12:
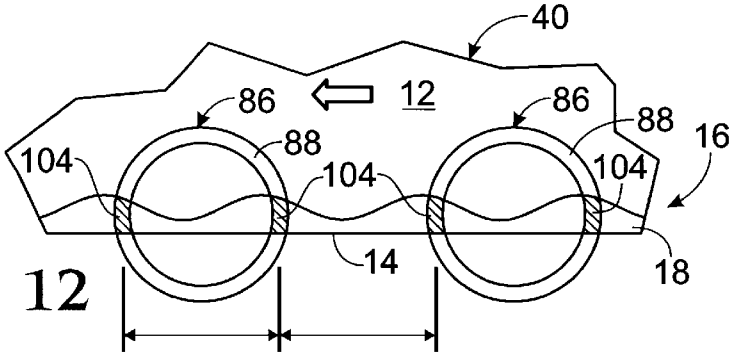
FIG. 12 is an enlarged detail showing a pair of the treatment heads of FIG. 11 engaging the edge region of the work piece to produce a wave bevel thereon.
Figure 13:
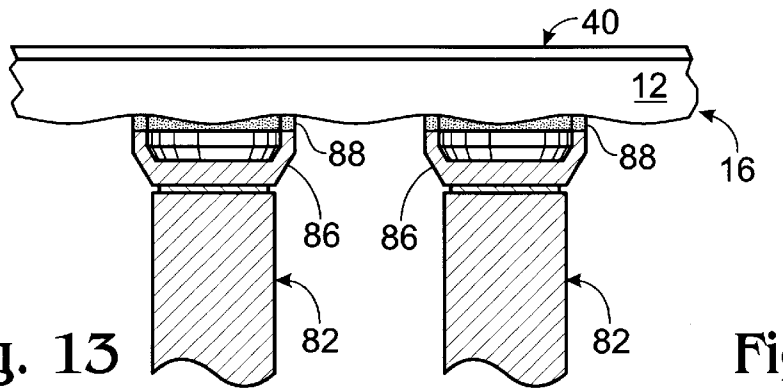
FIG. 13 is an enlarged detail taken along curved line 13 in FIG. 8 and showing two of the treatment heads oriented to each have a pair of contact regions that engage the edge region of the work piece.

As shown in FIG. 8, the heads 82 are mounted in a generally parallel configuration on a bed 90. Furthermore, as shown in FIGS. 8 and 12–13, each of the heads is oriented so that its axis is generally perpendicular to the work piece. In this configuration, each head 82 has a pair of contact regions 104, shown in FIG. 12, that are adapted to engage edge region 16 when the heads and work piece 40 are in contact with each other. By two contact regions, it is meant that treatment surface 88 of the head simultaneously engages the work piece in two locations, one adjacent each side of wheel 86, as the wheel spins on its axis.

Figure 11:
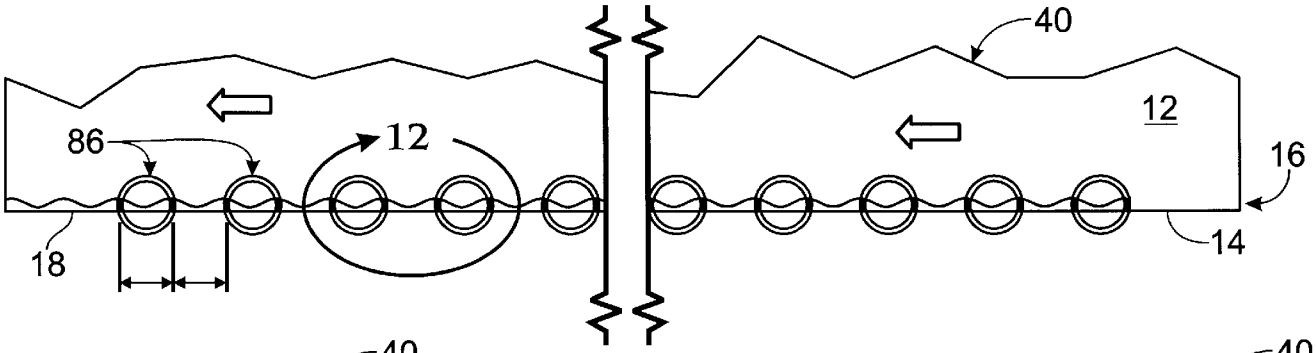
FIG. 11 is a cross-sectional view of the work piece and the plurality of treatment heads taken along line 11—11 in FIG. 8.

It should be understood that each contact region 104 should be spaced-apart from each adjacent contact region so that the regions are in phase with each other. By this it is meant that each contact region 104 will follow the same path along edge region 16 of the work piece. Therefore, each contact region 104 will abrade or polish the edge region at the same relative position of the produced wave bevel as the immediately preceding contact region. For example, in FIGS. 11 and 12, contact regions 104 are each positioned to engage respective ones of the crests of wave bevel 18 at the same time.

To achieve this result, the spacing between adjacent contact regions 104 must be an integer multiple of the wave length of the wave bevel to be produced or else the contact regions will not all engage edge region 16 at the same relative point within the repeating wavelength of the wave bevel. When each head 82 has a pair of contact regions 104, this minimum spacing must also be an even divisor of the diameter of wheel 86. The primary benefit of each head 82 having a pair of contact regions 104 is that the machine can produce the finished wave bevel in less time and with less heads than if each head only had a single contact region.

To continue the example being used herein, if each wheel 86 has inner and outer diameters of 110 millimeters and 130 millimeters, respectively, the distances between the centers of each side of the wheels should be an integer multiple of 120 millimeters. The wavelength, or pitch, of wave bevel 18 will be determined by how many complete oscillations of the contact regions, generally toward and away from the work piece, occur as main conveyors 48 and 50 move work piece 40 a specified distance along feed path 36. For example, for every 120 millimeters main conveyors 48 and 50 move the work piece along feed path 36, if the contact surfaces complete one, two, three or four oscillations, machine 30 will respectively produce a wave bevel with a wavelength of 120, sixty, forty and thirty millimeters. The number of oscillations that occur is determined by transmission 110, as discussed below.

Figure 14:
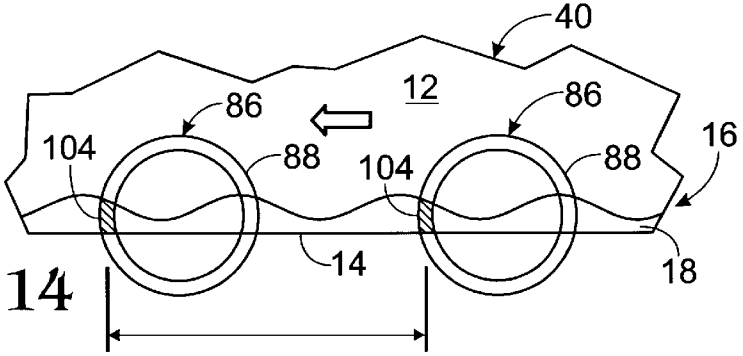
FIG. 14 shows the treatment heads of FIG. 12 in an alternate orientation in which each head has a single contact region that engages the edge region of the work piece.
Figure 15:
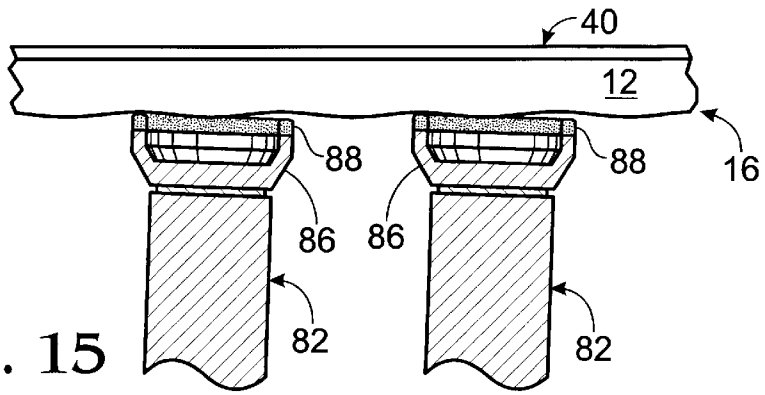
FIG. 15 shows the treatment heads of FIG. 13 in an alternate orientation in which each head has a single contact region that engages the edge region of the work piece.

An alternate configuration of heads 82 is shown in FIGS. 14 and 15. In this configuration, each head 82, or at least the wheel 86 of each head, is angled relative to the plane of the edge region by a few degrees so that each wheel 86 only has a single contact region 104 with edge region 16 of work piece 40. As shown in FIG. 15, each wheel 86 is tilted a few degrees relative to the position shown in FIG. 13. It should be understood that the degree of tilt may vary as long as the head is sufficiently tilted relative to the edge region that it only has one contact region with the edge region.

When heads 82 are mounted along bed 90 in this alternate configuration, the spacing of the heads is still dictated by the distance between adjacent contact regions, as indicated in FIG. 14, however, it is no longer dependent upon the diameter of wheel 86. Instead, the heads must be spaced-apart along bed 90 so that the contact region 104 of each head 82 is spaced away from each adjacent contact region by an integer multiple of the desired bevel wavelength. Accordingly, it should be understood that heads 82 should be adjustably mounted along bed 90 so that the relative spacing between the heads may be adjusted prior to use of the machine in accordance with the wavelength of the wave bevel to be produced. The primary benefit of each head 82 only having a single contact region is that the user can produce a wider variety of wave bevels because the spacing of the heads are not constrained by the diameter of each wheel 86.

In addition to presetting the spacing of and between the heads, including whether the heads are positioned to have one or more contact regions with the work piece, it is also necessary to preset the angle at which the heads engage the edge region of the work piece. As seen by referring back to FIG. 10, wheel 86 extends at an angle with respect to edge region 16 of work piece 40. Adjusting the angle of wheels 86 relative the edge region 16 will affect the ratio of the widths and heights of the produced wave bevel. More specifically, adjusting the angle of wheels 86 has an opposite effect on the relative height and width of the produced wave bevel. For example, from the position shown in FIG. 10, decreasing the angle of the wheel 86 with respect to face 12 will increase the width of the wave bevel and/or decrease the height. On the other hand, if this angle is increased, then the width is decreased and/or the height is increased. It should be understood that this relative height and width is dependent upon the angle of the wheel with respect to the edge region of the work piece, but the actual height and width of the produced wave bevel is further dependent upon the depth to which the wheels abrade glass from the work piece.

With the plurality of treatment heads 82 now positioned and angled relative to edge region 16 of work piece 40, the treatment head positioning system or controller is used to move the work piece and the plurality of heads with respect to each other to produce a wave bevel as the work piece is moved along feed path 36. More specifically, the system repeatedly moves the work piece and/or the plurality of heads in an oscillating pattern as the contact surfaces are engaged with or by the edge region of the work piece. As the edge region and contact regions are in engagement, the contact regions treat at least a portion of the edge region, such as by abrading or polishing the portion to produce or finish the wave bevel. At least some of the heads abrade glass from the edge region to create or shape the wave bevel. Several embodiments of the treatment head positioning system are described below.

Figure 16:
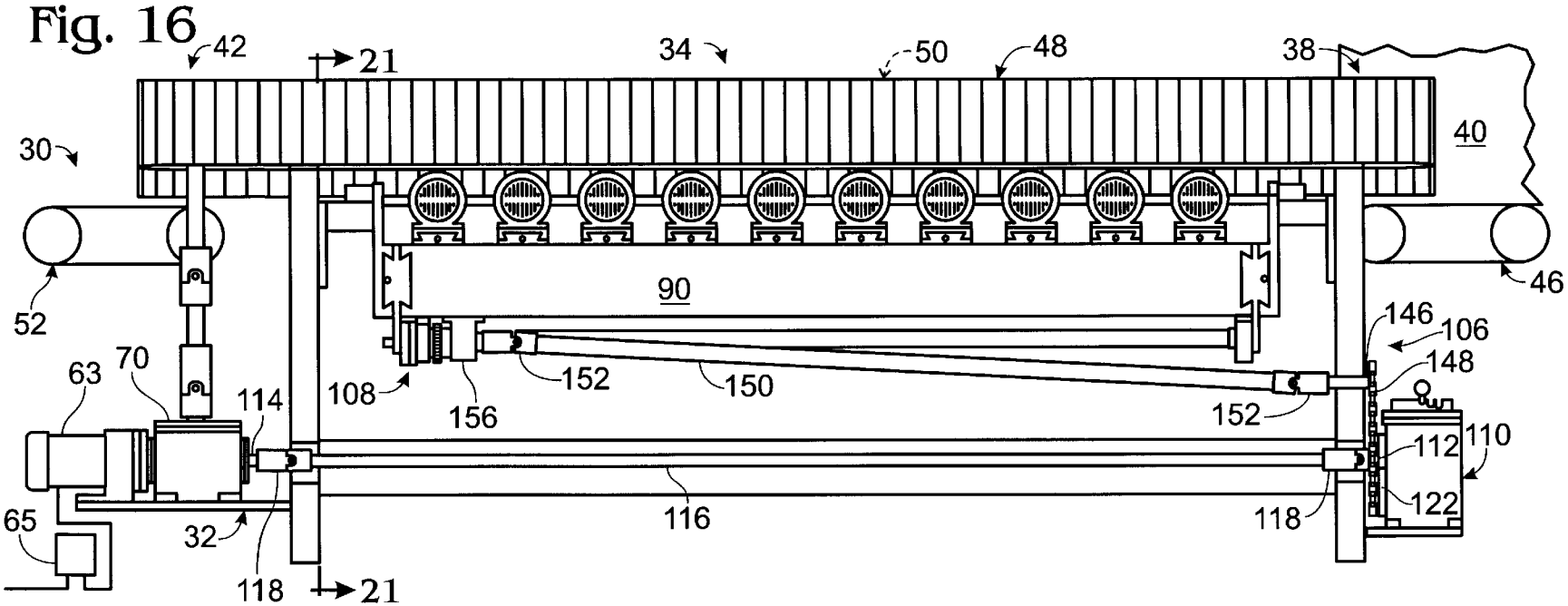
FIG. 16 is a front elevation view of an alternate embodiment of the wave beveling machine that includes a translation control system which moves the plurality of heads toward and away from the edge region of the work piece as the work piece is moved along the feed path of the machine.
Figure 20:
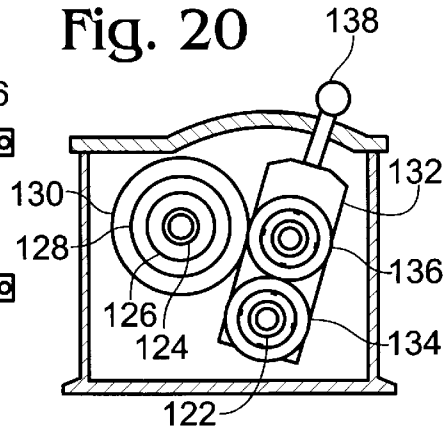
FIG. 20 is a cross-sectional view of the transmission shown in FIG. 16 taken along the line 20—20 in FIG. 17.
Figure 19:
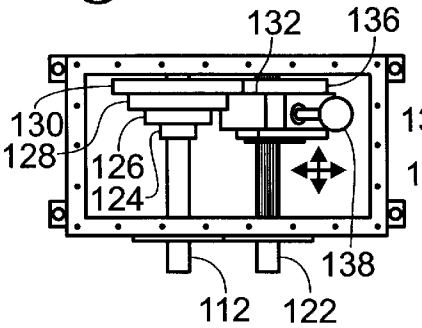
FIG. 19 is a cross-sectional view of the transmission shown in FIG. 16 taken along the line 19—19 in FIG. 18.
Figure 18:
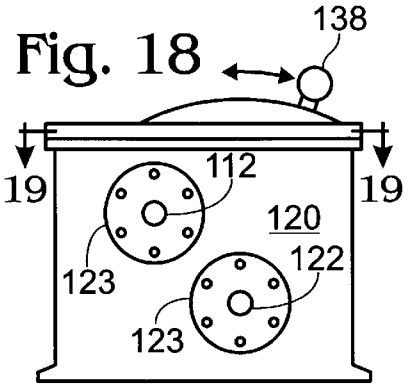
FIG. 18 is a left elevation view of the transmission shown in FIG. 16.
Figure 17:
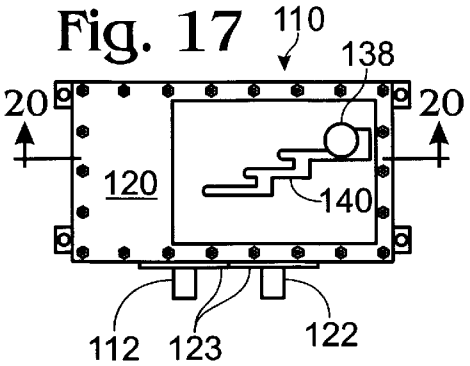
FIG. 17 is a top plan view of the transmission shown in FIG. 16.

A first embodiment of the treatment head positioning system is indicated generally at 106 in FIG. 16 and includes a translation control system 108 that is adapted to cause the plurality of treatment heads 82 to oscillate as a unit in a translational motion with respect to the feed path to engage edge region 16 of work piece 40 as the work piece is moved along feed path 36. As heads 82 are repeatedly moved as a unit in this oscillating motion, their contact region or regions 104 engage the edge region of the work piece at the present angle to abrade and/or polish the edge region to produce the desired wave bevel. As work piece 40 is moved along the feed path, contact regions 104 of the plurality of heads are translated in a reciprocating path generally toward and away from the feed path to produce a wave bevel 18 with an oscillating width 20 and height 22, as shown in FIGS. 5 and 6.

It should be understood that wheels 86 (and typically the entire treatment heads) will be inclined at an angle with respect to the feed path and the edge region of any work piece supported thereby. The angle may be adjusted by securing bed 90 at an angle with respect to the feed path, or by pivoting and securing each of the heads at an angle on bed 90. Furthermore, the selected angular position of the bed and/or the plurality of treatment heads may be adjusted in any suitable manual, or preferably automated, manner, several embodiments of which are described or suggested herein as illustrative examples.

As shown in FIG. 16, system 106 includes a transmission, such as mechanical transmission 110, that includes an input shaft 112, which is coupled to and at least partially driven by an extended input shaft 114 on the previously described gear reducer 70 by a shaft 116 and a series of universal joints 118. As extended input shaft 114 rotates, shaft 116 and joints 118 are rotatably driven and convey this power through input shaft 112 to transmission 110. Transmission 110 controls the rate at which the plurality of heads are translated in their oscillating path with respect to feed path 36 and along edge region 16 when a work piece is moved along feed path 36 through work zone 34. In the embodiment shown in FIG. 16, this speed is controlled as a function of the speed at which main conveyors 48 and 50 move work piece 40 along feed path 36 and through work zone 34. Therefore, as shown, transmission 110 controls the number of oscillations of the heads as the work piece travels a defined distance along feed path 36.

As shown in FIGS. 17–20, transmission 110 includes a housing 120 into which and from which rotatable input and output shafts 112 and 122 respectively extend through flanges 123. A plurality of input gears 124–130 with different diameters are mounted on input shaft 112, and a user-adjustable lever 132 with an output gear 134 is mounted on output shaft 122. A linkage gear 136 is rotatably mounted on lever 132 and is drivingly engaged with output gear 134 so that rotation of either output gear 134 or linkage gear 136 causes the other to rotate as well. It should be understood that each of the previously described gears 124–136 have a plurality of radially spaced-apart teeth extending along the perimeter thereof. Preferably, all of the teeth have the same general size and spacing.

By adjusting the pivotal and lateral position of lever 132, such as with handle 138, a user is able to select the relative speed of rotation of output shaft 122 with respect to input shaft 112. Transmission 110 may further include a guide 140 that directs the user's adjustment of lever 132 with respect to the input gears. It should be understood that the speed of rotation of output shaft 122 is determined by the speed of rotation of input shaft 112 and a ratio of the relative sizes of the engaged input gear and the output gear.

For example, if output and linkage gears 134 and 136 have fifty teeth, and input gears 124–130 respectively have twenty, forty, sixty and eighty teeth, the user can select four different relative speeds of rotation of output shaft 122 depending on which input gear 124–130 is engaged by linkage gear 136. An example of these settings are presented below in the following table using the ratios and sizes presented in the previously described illustrative examples.

| Teeth on Input Gear | Gear Ratio | Speed Ratio | Oscillations of Heads per 120 mm Traveled by the Work Piece | Wavelength of Wave Bevel |
|---|---|---|---|---|
| 20 | 20:50 | 2.5:1 | 1 | 120 mm |
| 40 | 40:50 | 2.5:2 | 2 | 60 mm |
| 60 | 60:50 | 2.5:3 | 3 | 40 mm |
| 80 | 80:50 | 2.5:4 | 4 | 30 mm |

It should be further understood that the number and relative sizes of gears 124–136 may vary according to the degree of control desired for a particular machine. For example, transmission 110 may include multiple output gears, such as to provide for low, medium and high speed settings. Additionally, mechanical transmission 110 may be located in any suitable position on or adjacent frame 32, so long as the necessary connections are made to enable the movements described herein. Transmission 110 may also be replaced with a computer controlled or other electrical transmission that similarly enables the control of the relative speeds of rotation of main conveyors and the rate at which the heads oscillate in their translational path as the work piece is moved along the feed path.

Figure 22:
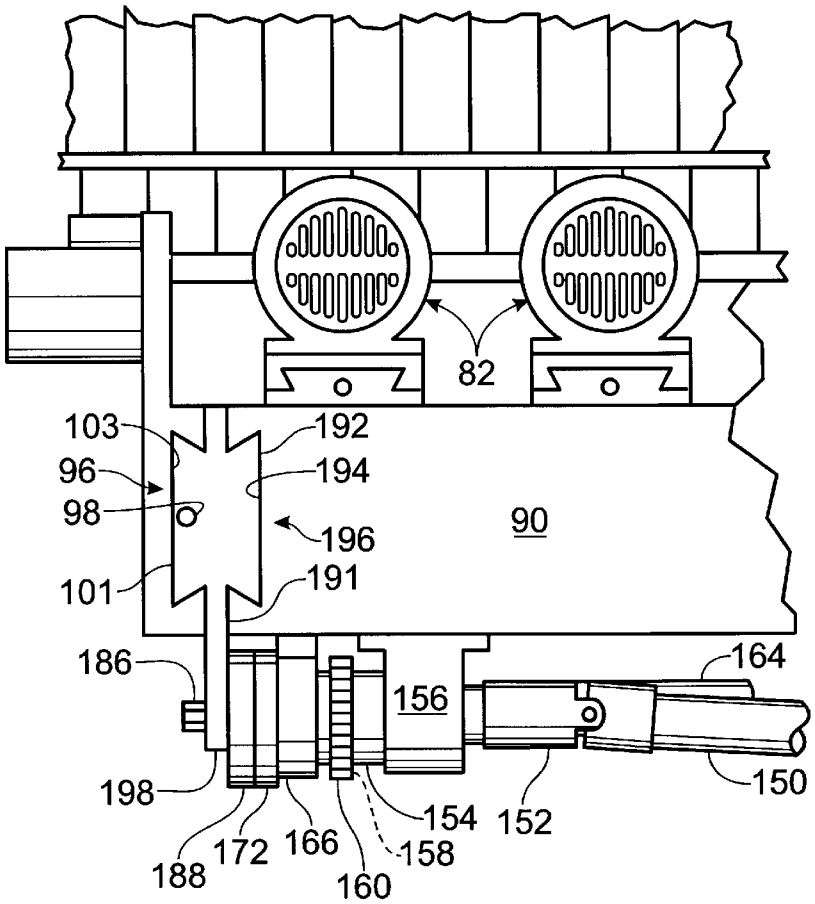
FIG. 22 is an enlarged detail of the machine of FIG. 16 showing a pair of treatment heads mounted on a bed and a portion of the translation control system.
Figure 21:
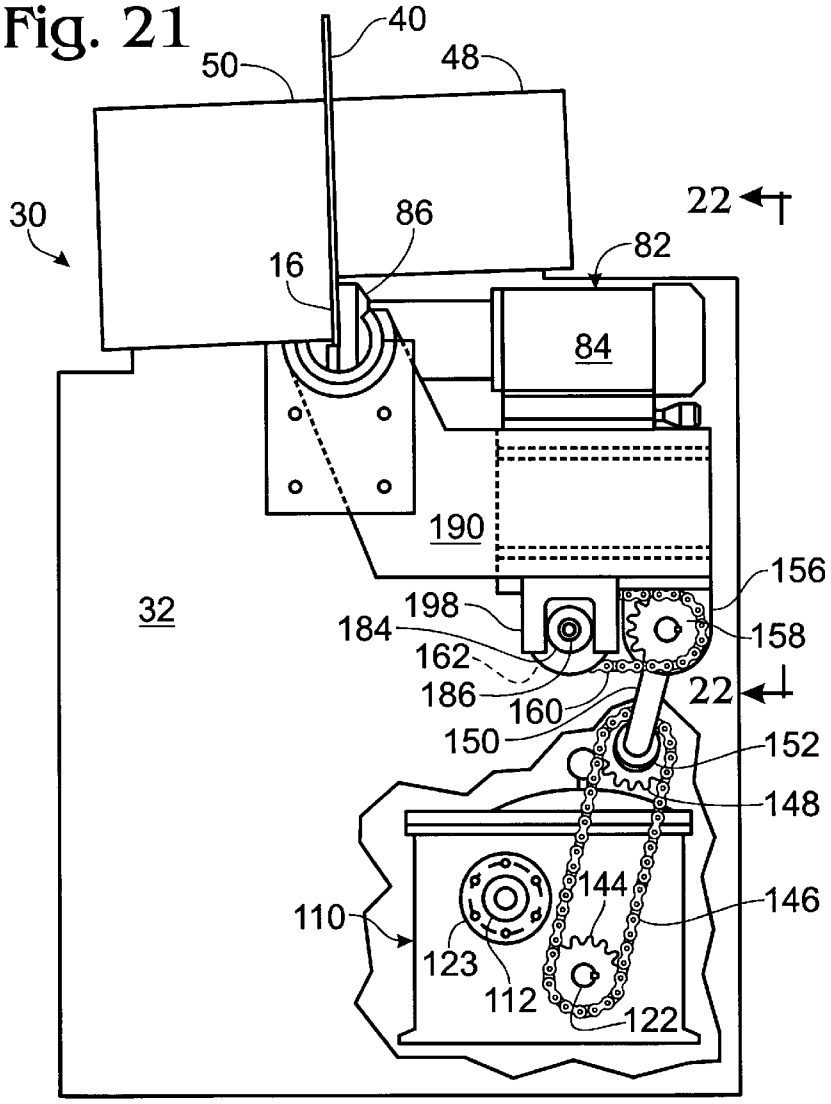
FIG. 21 is cross-sectional side view of the wave beveling machine of FIG. 16 taken along the line 21—21 in FIG. 16 with a portion of the frame broken away.

In FIG. 21, it can be seen that output shaft 122 of transmission 110 has a sprocket 144 mounted thereon that is drivingly coupled via chain 146 to another sprocket 148 on the side of frame 32. The speed of rotation of output shaft 122 is passed from sprocket 148 through another elongate shaft 150 and pair of universal joints 152 to a rotatable member 154 that is secured to the lower surface of bed 90 by a mounting bracket 156, as shown in FIG. 22, which may also be referred to as a bearing case or bearing housing. As discussed below, bed 90 will translate and/or pivot with respect to feed path 36, however, the universal joints enable the above-described connections to be maintained even as bed 90 is moved with respect to the feed path.

As shown in FIGS. 22 and 23, rotatable member 154 includes a sprocket 158 and is connected via chain 160 to another sprocket 162 that is mounted on a main shaft 164. Main shaft 164 extends along the length of bed 90 and is rotatably mounted adjacent each end of bed 90 by bearing cases 166, as shown in FIGS. 22–25. As shaft 164 rotates at the speed determined in part by transmission 110, its speed of rotation is transferred through rotatable member 154 to main shaft 164, which rotates and is maintained adjacent bed 90 by bearing cases 166.

At least one of the ends 168 and 170 of main shaft 164 has a flange-like region 172 that is perhaps best seen in FIG. 24. Within main shaft 164 and extending outwardly from each end 168 and 170 is an eccentric cam shaft 174 that converts the rotation of main shaft 164 into back and forth translational movement of bed 90. Cam shaft 174 further includes double eccentric ends 175 that extend outwardly from flange-like portion 172 of main shaft 164 to define a common axis 176 that is offset from the axis 177 of the portion of cam shaft 174 within main shaft 164, as shown in FIG. 24. Furthermore, axis 177 of cam shaft 174 is offset from the axis 178 of main shaft 164. As shown, axes 176–178 extend in a parallel, offset relationship to each other.

Cam shaft 174 is secured within shaft 164 and prevented from rotating therein by a clamping flange 180. Flange 180 is secured to flange-like region 172 of end 168 by a pair of clamping bolts 182 (shown in FIG. 25). Each end 175 of cam shaft 174 extends outwardly from the ends of main shaft 164 through a bearing 184 and terminates with a bolt-like head 186. As shown, cam shaft 174 also includes a flange-like region 188 that extends adjacent flange-like region 172 of main shaft 164.

By referring briefly back to FIG. 22, it can be seen that each male portion 101 of outer slides 96 extends from an extended plate 191 that further includes a second male portion 192 extending inwardly toward bed 90. Second male portions 192 are received by second female portions 194 to form inner slides 196 that support and guide bed 90 as it translates toward and away from feed path 36. Furthermore, in FIG. 21, it can be seen that each extended plate 191 includes a clamp 198 that straddles bearings 184 and the ends of cam shaft 174.

As main shaft 164 is rotated about its axis 178, the portion of cam shaft 174 within main shaft 164 is eccentrically rotated with the main shaft, with its axis 177 revolving about axis 178 of the main shaft. Ends 175 of cam shaft 174 similarly rotate eccentrically from the rest of cam shaft 174 Because ends 175 are laterally straddled by clamps 198, they urge the entire bed to translate along inner slide 196 toward and away from feed path 36 along the translational track defined by slides 196 as the ends rotate about their axis, thereby adjusting the position of the heads and their treatment surfaces with respect to the feed path and the edge region of any work piece moved thereupon.

The degree to which bed 90 translates along inner slides 196 as the work piece is moved along feed path 36 is adjustable by varying the extend to which axis 176 of ends 175 is offset from axis 178 of main shaft 164. To adjust the distance between the axes 176 and 178, clamping bolts 182 are loosened to release flange 180 and permit the cam shaft to be rotated within the main shaft. Typically, a wrench or other suitable device is used to engage at least one of the heads 186 and turn cam shaft 174 within main shaft 164. By rotating cam shaft 174 about its offset axis 177 within main shaft 164, the axis of ends 175 is moved closer or farther away from the axis of main shaft 164. When axes 176 and 178 are aligned, bed 90 will not translate with respect to the feed path because ends 175 and main shaft 164 are rotated about a concentric axis.

To enable a user to gauge the degree of offset between the axes of ends 175 and main shaft 164, cam shaft 174 further includes an indicator 200. As shown in FIG. 25, indicator 200 measures the offset within a range of zero to six millimeters. It should be understood that the indicated value is actually twice as large as the actual distance between the axis of the main shaft and the axis of ends 175 because the rotation of these axes about each other creates a translational path that is twice as wide as the actual distance between the axes. It should be further understood that the range of offset between axes 176 and 178 may vary between any suitable limits, depending on the degree to which the width and height of the produced wave bevels might oscillate along the length of edge region 16.

Figures 26, 27, 28:
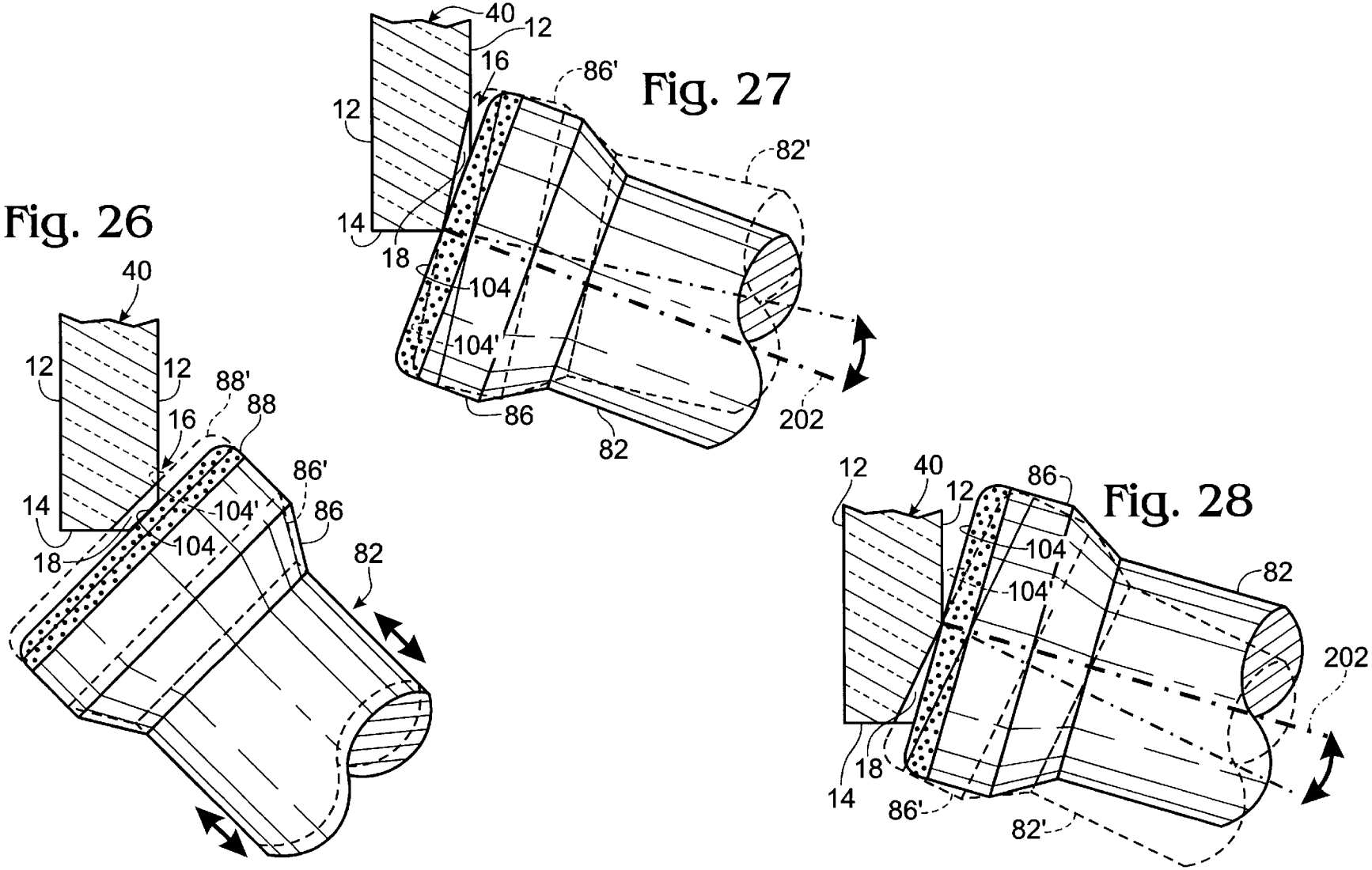
FIG. 26 shows the reciprocating translational path of one of the treatment heads shown in FIG. 16 as it engages the edge region of a glass work piece as the work piece is moved along the feed path.
FIG. 27 shows a first reciprocating pivotal path of one of the treatment heads engaging the edge region of a glass work piece as the work piece is moved along the feed path.
FIG. 28 shows a second reciprocating pivotal path of one of the treatment heads engaging the edge region of a glass work piece as the work piece is moved along the feed path.

In FIG. 26, the translational path of one of heads 82 with respect to edge region 16 of a work piece is shown. Wheel 86 and treatment surface 88 of the head are shown in a first position in solid lines. In this first position, the contact regions 104 of wheel 86 engage edge region 16 at a crest of wave bevel 18, in which the width 20' and height 22' are at their smallest value. This position is indicated in FIG. 5 with the line 26—26. From this first position, as the plurality of treatment heads 82 are moved, independently or as a unit, deeper into work piece 40, the width and height of wave bevel 18 increase until wheel 86 and treatment surface 88 are in a second position, in which each contact surface 104 engages edge region 16 at a trough of wave bevel 18. This position is shown in dashed lines in FIG. 26 and corresponds to the position indicated with line 6—6 in FIG. 5. In this second position, the width 20 and height 22 of wave bevel 18 are at their largest value. It should be understood that the head reciprocates between the first and second positions in this oscillating, and preferably periodically oscillating, motion as work piece 40 is moved through work zone 34 to produce wave bevel 18 on the edge region of the work piece.

As discussed, the relative amplitudes of the width and the height of the wave bevel are defined by the angle and depth of the heads with respect to edge region 16 of the work piece. For example, as shown in FIG. 26, head 82 is positioned at approximately a 45° angle with respect to the produced wave bevel 18. As such, width 20 and height 22 of the wave bevel will have equal amplitudes, as shown. To increase the amplitude of the widths of the wave bevel relative to the amplitude of its heights, the angle of the heads should be decreased relative to the place of face 12. With this method of producing wave bevel 18, however, it should be understood that the amplitudes of the height and the width of the wave bevel are inversely proportional. Therefore, any increase in the amplitude of width 20 results in a decrease in the amplitude of the height 22.

In variations of this embodiment, the conveyors and translation control system may be separately powered and driven. The previously described treatment head positioning system, which preferably is computerized and responsive to a variety of user inputs, monitors and controls the speeds of rotation of the motors and shafts through a series of suitable indicators and feed back mechanisms. This enables the system to control the speed of the conveyors and the rate at which the plurality of heads are moved toward and away from the feed path as the work piece is moved along the feed path by the main conveyors. Similarly, the system may control, by adding suitable linkages and drive units, other adjustments and positions such as the position of each of the plurality of heads with respect to each other and with respect to feed path 36, as well as the position of bed 90 on the outer slides and the degree to which the axes 176 of the ends of cam shaft 174 are offset from axis 178 of main shaft 164.

In another variation of the above-described embodiment, the translation control system engages and supports the work piece and causes the work piece to translate toward and away from the plurality of treatment heads, which remain in a stationary (non translating or pivoting) position relative to the frame of the machine as the work piece is moved along the feed path. For example, the main conveyors may be adapted to move toward and away from the bevel wheels as they move the work piece through the work zone. In this embodiment, the conveyors not only move the work piece along the feed path, but also translate the work piece in an oscillating path toward and away from the treatment heads. The system may include additional support structure to maintain a secure grip on the work piece so the position of the work piece may be precisely controlled along the work zone and toward and away from the bevel wheels.

The translation control system is preferably computer controlled in this embodiment, although a mechanical control system may also be used. As the work piece is oscillated toward and away from the bevel wheels in this translational motion, a wave bevel is produced on its edge region by the engagement between the edge region and the contact surfaces. It should be understood that in all embodiments disclosed herein, the contact regions preferably never lose contract with the edge region, but instead create the wave bevel by repeatedly being moved deeper and shallower into the edge region. In a further variation, both the plurality of heads and the work piece are engaged and reciprocated along a translational path toward and away from each other.

In yet another embodiment, the treatment head positioning system controls the position of each head along its slide independent of the position of the rest of the plurality of heads. The system is then able to cause the heads to individually move in a translational motion toward and away from the feed path to create and/or follow the desired oscillating pattern of the wave bevel along the edge region of the work piece. Because the heads move independently of each other, the relative spacing between adjacent heads is not dictated by the wavelength of the wave bevel or the spacing of the heads. Instead, the controller moves the heads so that they are in phase with each other to define by grinding or polishing the same shape of wave bevel along the edge region of the work piece. With the arrangement, the wave bevel does not even need to be of a fixed wavelength as it extends along the length of the edge region. This embodiment enables the machine to be considerably shorter than the above-described embodiments.

As described above with respect to FIG. 26, reciprocally translating the edge region of the work piece and the plurality of treatment heads with respect to each other produces a wave bevel with an oscillating width and height. The amplitude of the width and height may be varied to produce a variety of shapes and sizes of wave bevels on edge regions of a work piece, however, sometimes it is desirable to have a wave bevel in which only the width or only the height oscillate along the length of the edge region.

For example, in FIG. 27, contact region 104 of the previously described treatment heads 82 is shown in solid lines engaging edge region 16 of a work piece 40. As shown, axis of rotation 202 of wheel 86 is centered over edge 14 of work piece 40. This position corresponds to the position indicated in FIG. 1 with the line 27—27 in which wave bevel 18 has a width 20' and a height 22. By pivoting head 82 or at least wheel 86 of head 82, toward face 12 of work piece 40 about a pivot axis that extends along the length of the intersection between edge 14 and wave bevel 18, the width of wave bevel 18 will increase in size from width 20' to a maximum width 20 while the height 22 of the wave bevel remains constant. The position of maximum width 20 is shown in dashed lines in FIG. 27 and corresponds to the position of the wave bevel shown in FIG. 1 along line 2—2.

It should be understood that width 20 is referred to as the maximum width because it corresponds to the smallest bevel angle or least tilt between face 12 of the work piece and the plane of wheel 86. A wave bevel with a larger width could be produced simply by further tilting wheel 86 about the previously described intersection axis toward face 12 from the position shown in dashed lines in FIG. 27. Furthermore, while wheel 86 is shown centered upon the intersection axis described above, it should be understood that wheel 86 can be pivoted about this axis from anywhere along the surface of wheel 86. The fact that the axis of rotation of wheel 86 intersects the axis about which the wheel is pivoted was merely for purposes of a point of reference between FIGS. 27 and 28.

To create a wave bevel with an oscillating height and a constant width, as shown in FIGS. 3–4 and 28, wheel 86 is pivoted with respect to edge region 16 as described above, however, the pivot axis of wheel 86 extends along the length of the edge region at the intersection between face 12 and wave bevel 18. As shown in solid lines in FIG. 28, wheel 86 is in engagement with edge region 16 at a position that corresponds to the line 28—28 in FIG. 3. In this position, wave bevel 18 has a width 20 and its smallest height 22'. As wheel 86 is pivoted about this intersection axis away from face 12, the height of wave bevel 18 is increased to a maximum height 22, which corresponds to the position of wheel 86 indicated in dashed lines in FIG. 28 and the position indicated in FIG. 3 by the line 4—4.

Figure 29:
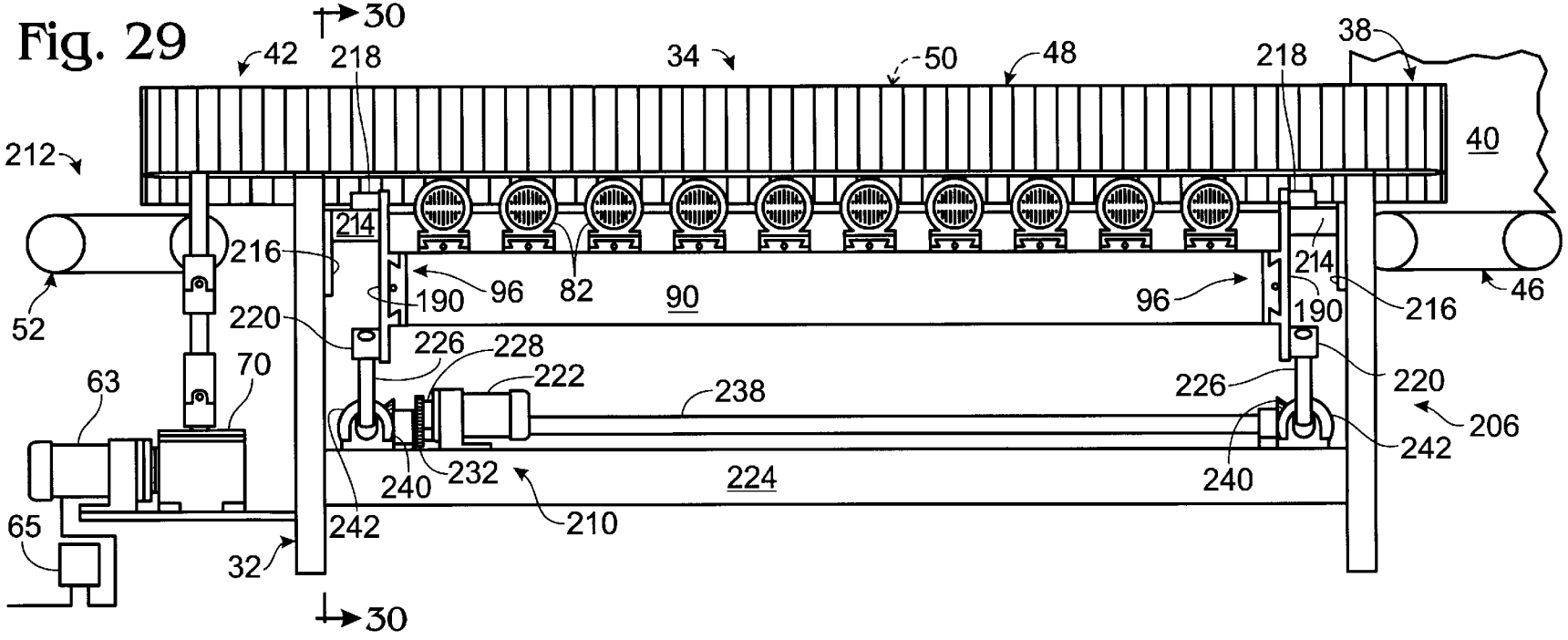
FIG. 29 is a front elevation view of an alternate embodiment of the wave beveling machine that includes a pivot control system that pivots the plurality of treatment heads with respect to the edge region of a glass work piece as the work piece is moved along the feed path of the machine.
Figure 31:
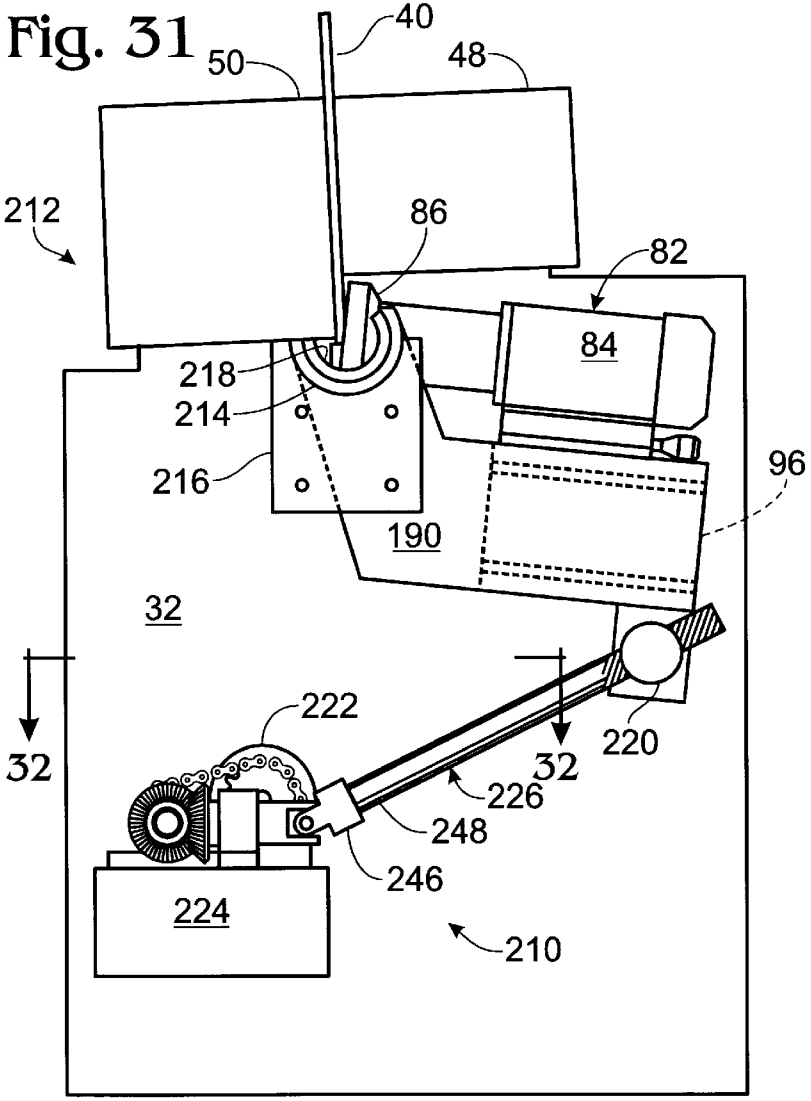
FIG. 31 is a side elevation view of the machine of FIG. 30 showing the plurality of heads and the bed in a pivoted position in which the bed and the plurality of heads are pivoted with respect to the first position.

Another embodiment of the invented wave beveling machine is shown in FIG. 29 and indicated generally at 212. In this embodiment, treatment head positioning system 206 includes a pivot control system 210 instead of the previously described translation control system 108. Pivot control system 210 causes the plurality of treatment heads 82 to pivotally oscillate in a motion that is transverse to the direction in which work piece 40 is moved along feed path 36 to produce any of the wave bevels described above with either oscillating widths or oscillating heights.

Unless otherwise specified, machine 212 includes the same components and subcomponents as described in any of the above embodiments. For example, machine 212 includes a system of conveyors 46–52, a plurality of treatment heads 82, and a bed 90 as described above with respect to any of the previously described embodiments, however, bed 90 only includes the previously described outer slides 96. Because the bed and/or the plurality of heads do not translate toward and away from feed path 34 as the work piece 40 is moved along the feed path (as in the prior embodiments), there is not a need for the bed to contain the previously described inner slides 196. Outer slides 96 are still used, however, to adjust the relative spacing of the heads with respect to the feed path to adapt the machine to produce wave bevels on work pieces with different thicknesses.

Figure 30:
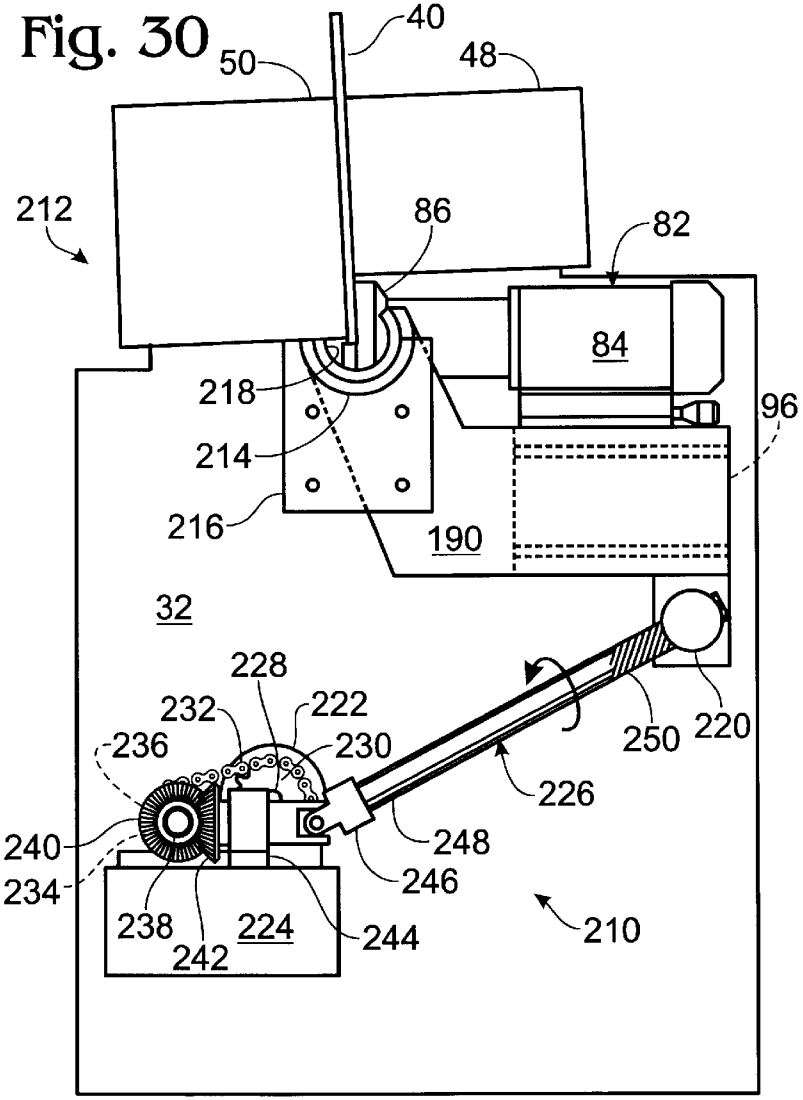
FIG. 30 is a side sectional view of the machine of FIG. 29 showing the plurality of heads and the bed in a first position.

As shown, machine 212 includes a pair of arcuate guides 214 that are rigidly mounted adjacent each end of the machine and which are supported by a pair of brackets 216. Each guide 214 supports and directs the pivotal movement of a pivot member 218 that is mounted to the upper portion of the previously described support plate 190 and extends into a corresponding one of guides 214, as shown in FIG. 30. Distal pivot member 218, each support plate 190 further includes a threaded nut 220 that is positioned to receive and be engaged by an arm-like screw, as described below.

Figure 32:
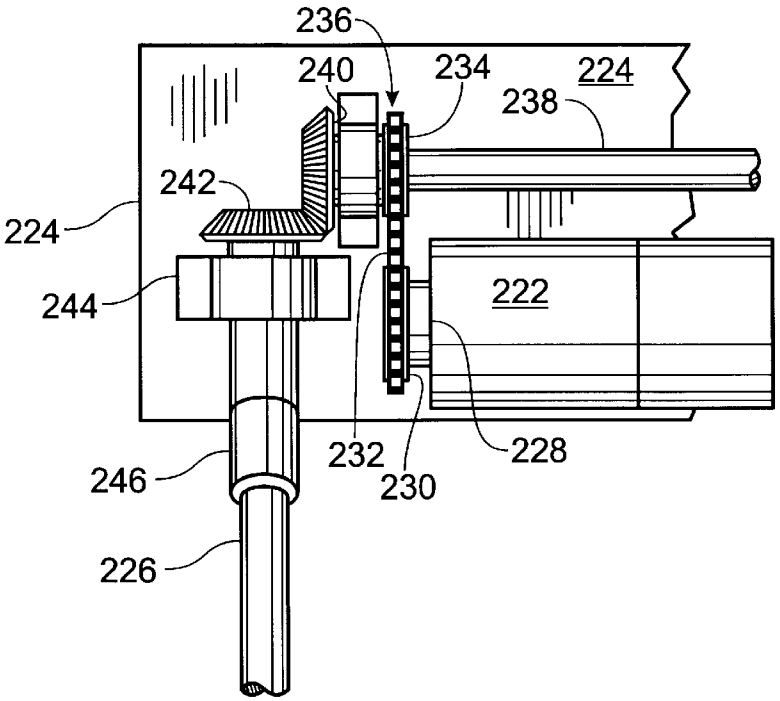
FIG. 32 is an enlarged detail taken along the line 32—32 in FIG. 31.

Machine 212 further includes a tilt motor 222 that is mounted on a platform 224 and which drives the rotation of a pair of arms 226, which are threadedly engaged with nuts 220. As shown in FIG. 32, motor 222 has an output shaft 228 that is drivingly coupled to a sprocket 230. A chain 232 extends around sprocket 230 and drivingly connects it to another sprocket 234 that is secured to a rotatable member 236 having an elongate shaft 238 with a bevel gear 240 on each end. Each bevel gear 240 is threadedly engaged with a second bevel gear 242 that conveys the rotational speed of the first bevel gear through a bracket 244 to a universal joint 246. Each universal joint 246 is drivingly connected to one end 248 of a respective one of arms 226. The other end 250 of each arm 226 is threadedly engaged by a corresponding one of the nuts 220.

As output shaft 228 of motor 222 is rotated, it causes sprockets 230 and 234 to rotate, which in turn cause bevel gears 240 and 242 to rotate. The rotational output of motor 222 is further conveyed to universal joints 246 and arms 226. As the arms rotate in the direction indicated in FIG. 30, they draw nuts 220 toward the first ends 248 of arms 226, and by doing so cause pivot members 218 to pivot along guides 214 and the rest of bed 90 and the plurality of heads 82 to similarly pivot with respect to the feed path and the edge region of any work piece moved thereupon. Preferably, the speed of rotation of output shaft 228 is controlled to correlate with the speed of rotation of output shaft 68 of motor 63.

Motor 222 is reversible and is controlled to alternatingly rotate output shaft 228 in opposite directions as a work piece is moved along the feed path. For example, motor 222 will rotate output shaft 228 in one direction for a determined length of time or number of rotations and then it will rotate shaft 228 in the other direction for an opposite length of time or number of rotations. This causes the plurality of treatment heads 82, including wheels 86, to move in a reciprocating pivotal motion that is transverse to the direction work piece 40 is moved along feed path 36. This pivotal movement causes the contact region or regions of each wheel 86 to create one of the wave bevels shown in FIGS. 1–4 and 27–28 as the work piece is moved along feed path 36. The actual shape of the produced wave bevel and the degree to which either the height or width of the bevel oscillates are determined as described above.

It should be understood that the invented wave beveling machine may include both the translation control and the pivot control systems described above to enable a user to selectively cause the plurality of heads to either pivot or translate with respect to the feed path and the edge region of any work piece moved thereon. An example of a wave beveling machine including both of these systems is shown in FIG. 7. It should be further understood that when the treatment head positioning system causes the heads to neither pivot nor translate as the work piece is moved along the feed path, then a conventional, non-oscillating, bevel can be produced along the edge region of the work piece. Furthermore, when the translation control system is used to cause the heads or work piece to move in a reciprocating translational path as the work piece is moved along the feed path, the pivot control system may be used to initially position the relative angle of the heads with respect to the edge region to define in part the relative amplitudes of the height and width of the produced wave bevel.

In another embodiment, the work piece remains in a fixed position and the plurality of heads are moved along the edge region of the work piece. While the heads are moved along the edge region of the work piece, their relative positions along the edge region are cyclically adjusted to produce the wave bevel on the edge region. This cyclical adjustment may include the previously described translational or pivotal motions to produce any of the previously described wave bevels.

Figure 35:
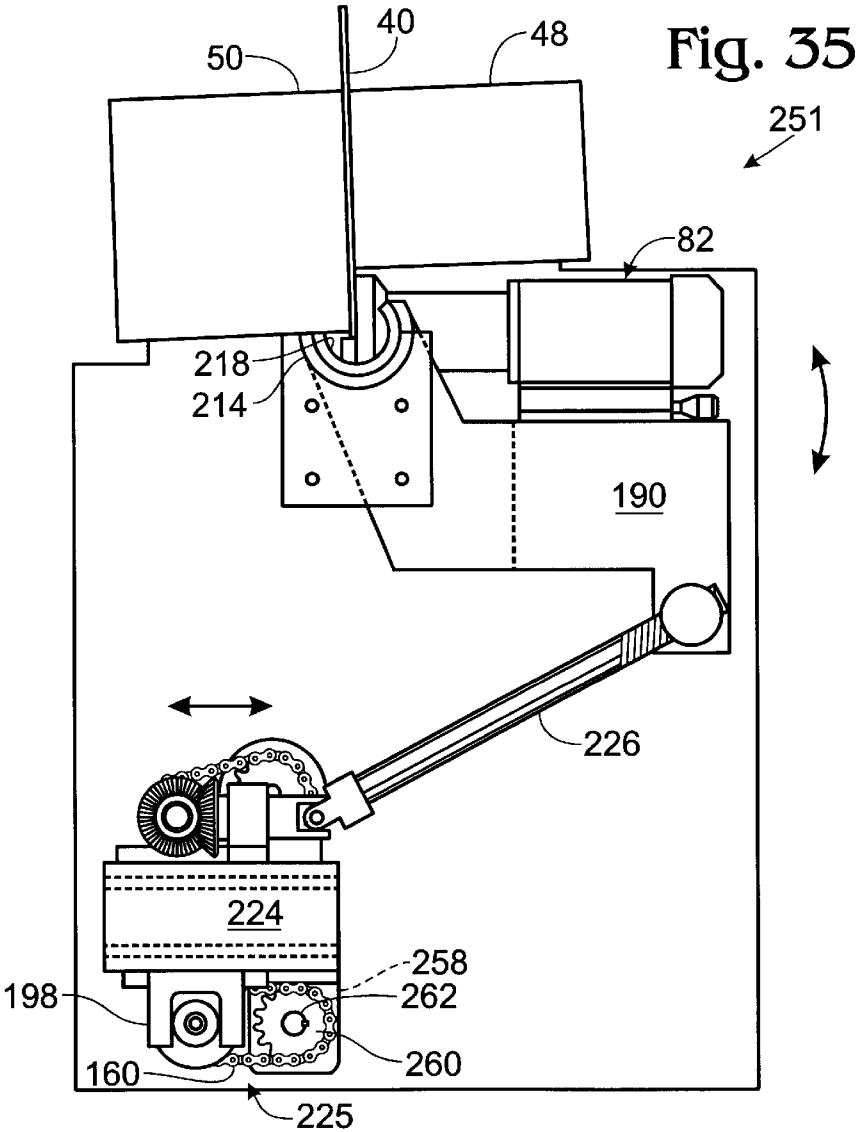
FIG. 35 is a side sectional view of the machine of FIG. 33.
Figure 33:
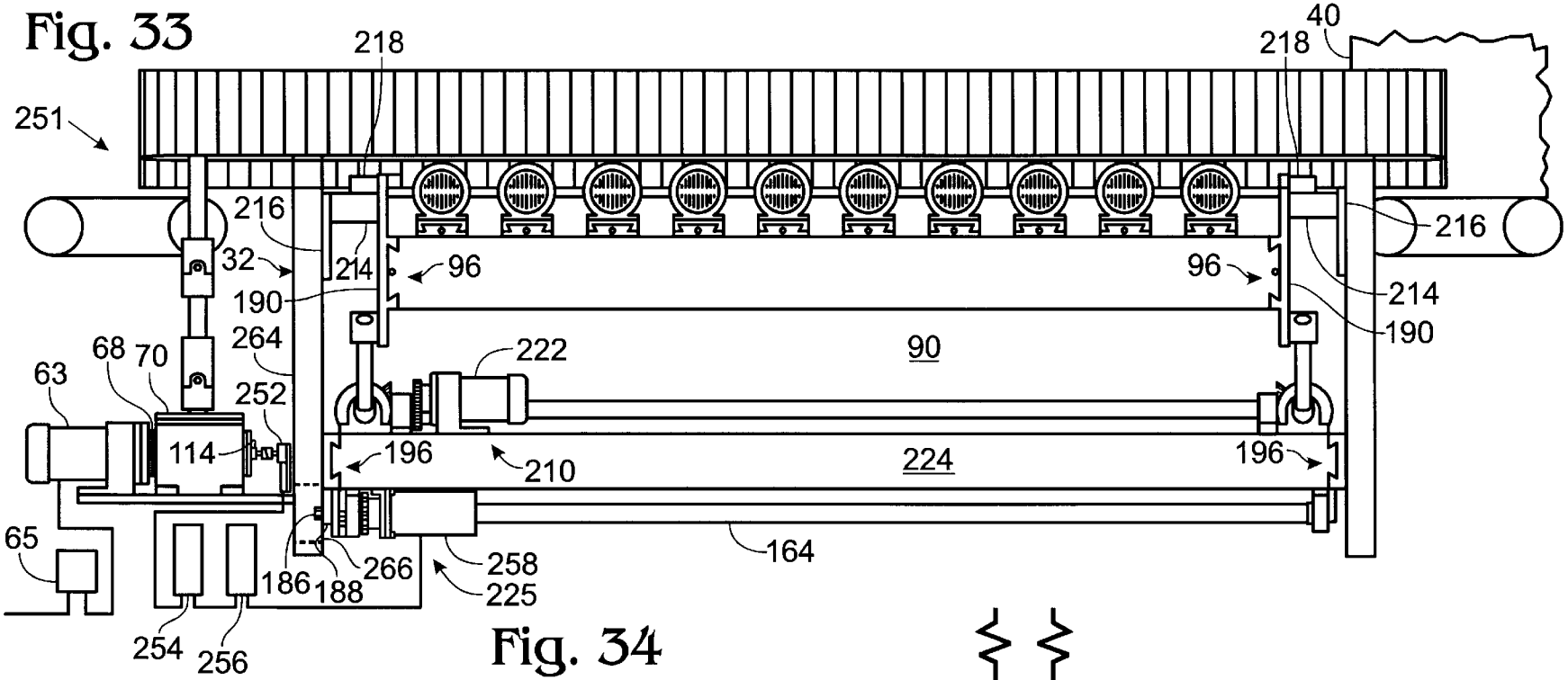
FIG. 33 is a front elevation view of another alternate embodiment of the wave beveling machine.
Figure 34:
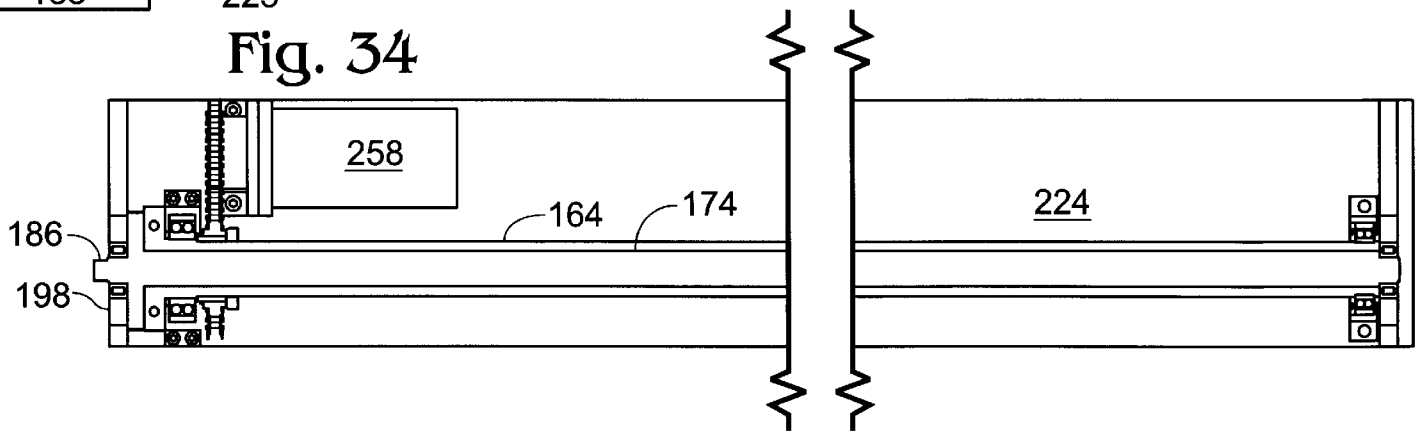
FIG. 34 is a bottom plan view of a bed of the machine of FIG. 33.

Another embodiment of the invented wave beveling machine is shown in FIGS. 33–35 and indicated generally at 251. Unless otherwise indicated, this embodiment includes the same components and subcomponents as any of the previously described embodiments and variants. In this embodiment, mechanical transmission 110 has been removed. Instead, extended input shaft 114 of reducer 70 is in communication with an encoder 252 that measures the speed of rotation of input shaft 68 and extended input shaft 114 and transmits these speeds, such as with a pulse signal, to an electronic transmission 254. Electronic transmission 254 receives this signal and uses it to control a power unit 256 for a servo motor 258, which is mounted on a platform 224.

Unlike the previously illustrated embodiments, in which outer slides 96 and clamps 198 were mounted and enables the slidable movement of bed 90, in FIG. 33, outer slides 196 and clamps 198 are now mounted on each end of platform 224 to enable platform 224 to translate toward and away from feed path 36. Furthermore, the previously described translation control system 106 is now mounted on the underside of platform 224 instead of bed 90, where it is indicated generally at 225. It should be understood that transmission 110 and its linkages have been removed from the translation control system and are replaced in this embodiment by encoder 252, electronic transmission 254, power unit 256 and servo motor 258.

As shown in FIGS. 34 and 35, servo motor 258 includes a sprocket 260 on its output shaft 262, which is coupled to the previously described sprocket 162 on main shaft 164 via chain 160. Because platform 224 is somewhat wider than bed 90, frame 32 may include a recess 266 which allows the heads 186 to translate toward and away from feed path 36 as platform 224 translates toward and away from feed path 36. For example, in FIG. 33, recess 266 is shown in side wall 264 of frame 32 to enable head 186 to translate with platform 224 without engaging the frame.

As shown in FIGS. 33 and 35, machine 251 further includes the previously described pivot control system 210. In this embodiment, pivot control system may be used to control the reciprocating pivotal path of the plurality of heads with respect to the feed path, as described above. Alternatively, the repositioned translation control system 225 may be used to cause the reciprocating pivotal motion of the plurality of heads. As cam shaft 174 and main shaft 164 are rotated about their respective axes, as described above, the eccentric ends 175 of cam shaft 174 now cause platform 224 to translate in a back and forth motion along the track defined by outer slides 196. This translational motion of platform 224 causes support plates 190 to pivot about pivot members 214, which in turn causes the plurality of heads to pivot with respect to the feed path.

It should be understood that the encoder, inverter, electronic transmission and power unit described above all may be included in the treatment head positioning system and used with any of the previously described embodiments of the invention to regulate and drive the engagement of heads 82 with the edge region of work piece 40 by controlling, for example, the speed of the conveyors and the translational or pivotal movement of the heads.

While the present invention has been shown and described with reference to the foregoing preferred embodiment, it is to be understood by those of skill in the art that other changes in form and detail may be made therein without departing from the spirit and scope of the invention as defined in the following claims. For example, the invented machine may be used to produce wave bevels on materials other than glass, such as stone, marble, plastic, wood, steel, and other similar materials. In some instances, it may be necessary to vary the composition of some of the treatment surfaces on the bevel wheels to adapt the machine to the particular material being beveled.

I claim:

1. A machine for producing a wave bevel on a glass work piece having a pair of opposed faces, an edge extending between the faces, and an edge region defined by the edge and a portion of at least one of the pair of faces adjacent the edge, the machine comprising:

a frame defining a work zone and having a feed path extending through the work zone from an entrance on one side of the work zone and an exit on the other side of the work zone;

a conveyor adapted to move the work piece along the feed path;

a plurality of spaced-apart treatment heads positioned within the work zone and adjacent the feed path, wherein the plurality of heads are configured to sequentially engage the edge region as the work piece is moved along the feed path, each head having a contact region that is adapted to engage the edge region of the work piece as the work piece is moved through the work zone, wherein at least one the contact regions abrades the edge region to remove glass therefrom; and a treatment head positioning system adapted to cyclically adjust the position of the plurality of heads with respect to the edge region as the work piece is moved through the work zone to produce a wave bevel on the edge region of the work piece.

2. The machine of claim 1, wherein each of the plurality of heads includes plural contact regions adapted to engage and produce a wave bevel on the edge region of the work piece.

3. The machine of claim 1, wherein the treatment head positioning system is adapted to move the plurality of heads in a reciprocating translational motion transverse to the feed path as the work piece is moved along the feed path.

4. The machine of claim 1, wherein the treatment head positioning system is adapted to move the plurality of heads in a reciprocating pivotal motion about an axis parallel to the feed path as the work piece is moved along the feed path.

5. The machine of claim 4, wherein each of the plurality of heads is pivotal independent of the rest of the plurality of heads about an axis parallel to the feed path, and further wherein a controller is adapted to control the pivotal movement of each of the heads to produce the wave bevel on the edge region as the work piece is moved along the feed path.

6. The machine of claim 1, wherein the machine includes a bed along which the plurality of heads are mounted, and wherein the treatment head positioning system moves the bed to cause the contact region of each of the plurality of heads to be simultaneously moved as a unit in an oscillating motion with respect to the feed path.

7. The machine of claim 6, wherein the bed is supported by a pair of slides that define a track extending generally transverse to the feed path, and further wherein the treatment head positioning system includes a translation control system adapted to translationally reciprocate the bed with respect to the feed path.

8. The machine of claim 6, wherein the bed is pivotally mounted on the frame, and further wherein the treatment head positioning system includes a pivot control system adapted to pivot the bed about an axis parallel to the feed path as the work piece is moved along the feed path.

9. The machine of claim 1, wherein the wave bevel has a fixed pitch, and the distance between adjacent ones of the plurality of grinding heads is (n)(p), where p is the pitch of the wave bevel and n is an integer greater than zero.

10. The machine of claim 1, wherein the wave bevel has an oscillating width measured from the edge along at least one of the faces in a direction transverse to the edge.

11. The machine of claim 1, wherein the wave bevel has an oscillating height measured along the edge and in a direction transverse to the faces.

12. The machine of claim 1, wherein the wave bevel has an oscillating height measured along the edge and in a direction transverse to the faces, and an oscillating width measured from the edge along at least one of the faces and in a direction transverse to the edge.

13. A machine for producing a wave bevel on a glass work piece having a pair of opposed faces, an edge extending between the faces, and an edge region defined by the edge and a portion of at least one of the pair of faces adjacent the edge, the machine comprising:

a positioning device adapted to receive and support the work piece;

a plurality of spaced-apart grinding heads adapted to engage laterally spaced-apart portions of the edge region of the work piece, each head having a contact region that selectively treats the edge region of work piece when the edge region and contact regions are in engagement with each other; and a treatment head positioning system adapted to cause oscillating engagement of the edge region and the plurality of heads to produce a wave bevel on the edge region of the work piece.

14. The machine of claim 13, wherein the treatment head positioning system includes a transport mechanism adapted to move the work piece with respect to the plurality of heads.

15. The machine of claim 13, wherein the treatment head positioning system moves the work piece with respect to the plurality of heads to produce the wave bevel on the edge region of the work piece.

16. The machine of claim 13, wherein the treatment head positioning system moves the plurality of heads with respect to the work piece to produce the wave bevel on the edge region of the work piece.

17. A machine for treating an edge region of a glass work piece to create a wave bevel thereon, wherein the work piece has a pair of opposed faces, an edge extending between the faces and an edge region defined by the edge and a portion of at least one of the faces adjacent the edge, the machine comprising:

a frame having a work zone and a transport mechanism adapted to carry the work piece through the work zone;

a plurality of treatment heads mounted on the frame in the work zone and adapted to sequentially treat the edge region of the work piece as it is carried through the work zone by the transport mechanism, wherein at least one of the treatment heads abrades away a portion of the work piece during contact therewith; and a treatment head positioning system adapted to move the heads relative to the edge region of the work piece in an predetermined oscillating pattern to thereby create a corresponding wave bevel on the edge region of the work piece as it passes through the work zone.

18. The machine of claim 17, wherein the wave bevel has an oscillating width measured from the edge along at least one of the faces in a direction transverse to the edge.

19. The machine of claim 17, wherein the wave bevel has an oscillating height measured along the edge and in a direction transverse to the faces.

20. The machine of claim 17, wherein the wave bevel has an oscillating height measured along the edge and in a direction transverse to the faces, and an oscillating width measured from the edge along at least one of the faces and in a direction transverse to the edge.

* * * * *